US009452631B2

(12) United States Patent
Sekine et al.

(10) Patent No.: US 9,452,631 B2
(45) Date of Patent: Sep. 27, 2016

(54) LIGHT-EMITTING MEDIUM

(75) Inventors: Yoko Sekine, Tokyo-To (JP); Manabu Yamamoto, Ichikawa (JP); Mitsuru Kitamura, Tokyo-to (JP); Tsuyoshi Yamauchi, Abiko (JP); Akiko Kitamura, Nagareyama (JP); Sakurako Hatori, Nagareyama (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 13/814,826

(22) PCT Filed: Aug. 4, 2011

(86) PCT No.: PCT/JP2011/067876

§ 371 (c)(1),
(2), (4) Date: May 15, 2013

(87) PCT Pub. No.: WO2012/020693

PCT Pub. Date: Feb. 16, 2012

(65) Prior Publication Data

US 2013/0221656 A1 Aug. 29, 2013

(30) Foreign Application Priority Data

Aug. 9, 2010 (JP) ..... 2010-178915

(51) Int. Cl.
*B42D 15/00* (2006.01)
*B42D 15/10* (2006.01)
(Continued)

(52) U.S. Cl.
CPC ..... *B42D 15/00* (2013.01); *B41M 3/144* (2013.01); *B42D 25/29* (2014.10); *B42D 25/382* (2014.10);
(Continued)

(58) Field of Classification Search
CPC .... B42D 15/00; B42D 15/10; B42D 25/382; B42D 25/387; B42D 25/29; B42D 2033/04; B42D 2035/16; B42D 2035/44; B42D 2035/24; G07D 7/122; B41M 3/144
USPC ..... 283/72, 74, 91, 92, 94, 98, 109, 110, 283/114
See application file for complete search history.

(56) References Cited

U.S. PATENT DOCUMENTS 3,940,523 A * 2/1976 Lecoeur et al. ..... 428/38
5,178,418 A * 1/1993 Merry ..... B41M 3/14 283/73

(Continued)

FOREIGN PATENT DOCUMENTS

EP 1 179 808 A1 2/2002
EP 2 075 767 A1 7/2009

(Continued)

OTHER PUBLICATIONS

International Search Report dated Nov. 8, 2011 (with English translation).

(Continued)

*Primary Examiner* — Moshe Wilensky
*Assistant Examiner* — Justin V Lewis
(74) *Attorney, Agent, or Firm* — Burr & Brown, PLLC

(57) ABSTRACT

A light-emitting medium including a light-emitting image having a pattern area formed on a substrate by using a first fluorescent ink containing a first fluorescent material, a background area formed on the substrate by using a second fluorescent ink containing a second fluorescent material, and a overcoat layer formed on the first fluorescent material of the pattern area and the second fluorescent material of the background area. The first fluorescent material is made of a fluorescent material which emits light of blue color when UV-A is irradiated, and emits light of red color when UV-C is irradiated. The second fluorescent material is made of a fluorescent material which emits light of blue color or light of a color that is viewed as the same color as the blue color when the UV-A is irradiated, and emits light of green color when the UV-C is irradiated.

13 Claims, 19 Drawing Sheets

(51) Int. Cl.

| | |
|---|---|
| ***B41M 3/14*** | (2006.01) |
| ***G07D 7/12*** | (2016.01) |
| ***B42D 25/29*** | (2014.01) |
| ***B42D 25/382*** | (2014.01) |
| ***B42D 25/387*** | (2014.01) |

(52) U.S. Cl.

CPC ..... *B42D 25/387* (2014.10); *G07D 7/122* (2013.01); *B42D 2033/04* (2013.01); *B42D 2035/16* (2013.01); *B42D 2035/24* (2013.01); *B42D 2035/44* (2013.01)

(56) References Cited

U.S. PATENT DOCUMENTS

| | | | | |
|---|---|---|---|---|
| 6,127,073 | A * | 10/2000 | Nohr | B41M 3/14 283/85 |
| 7,575,253 | B2 * | 8/2009 | Iwanaga | 283/92 |
| 7,611,258 | B1 * | 11/2009 | Chase | 40/543 |
| 2004/0209096 | A1 | 10/2004 | Brehm et al. | |
| 2004/0241400 | A1 | 12/2004 | Friedl et al. | |
| 2006/0033325 | A1 * | 2/2006 | Maruvada | G11B 23/281 283/95 |
| 2006/0249951 | A1 * | 11/2006 | Cruikshank | B42D 25/351 283/92 |
| 2007/0085334 | A1 * | 4/2007 | Watanabe | B42D 25/328 283/72 |
| 2008/0012287 | A1 * | 1/2008 | Saxby | G09F 3/02 283/81 |
| 2010/0025980 | A1 * | 2/2010 | Choi | D01F 1/06 283/92 |

FOREIGN PATENT DOCUMENTS

| | | | |
|---|---|---|---|
| FR | 2 917 418 | | 12/2008 |
| JP | 63-167421 | A1 | 7/1988 |
| JP | 04-070394 | A1 | 3/1992 |
| JP | 3030534 | U | 11/1996 |
| JP | 08-324094 | A1 | 12/1996 |
| JP | 10-035089 | A1 | 2/1998 |
| JP | 10-081056 | A1 | 3/1998 |
| JP | 10-097737 | A1 | 4/1998 |
| JP | 10-129107 | A1 | 5/1998 |
| JP | 10-140500 | A1 | 5/1998 |
| JP | 10-250214 | A1 | 9/1998 |
| JP | 10-251570 | A1 | 9/1998 |
| JP | 10-315605 | A1 | 12/1998 |
| JP | 2003-112487 | A1 | 4/2003 |
| JP | 2003-335085 | | 11/2003 |
| JP | 2007-299173 | A1 | 11/2007 |
| JP | 2009-160837 | A1 | 7/2009 |
| JP | 4418881 | B2 | 2/2010 |
| WO | 03/011606 | A1 | 2/2003 |
| WO | 03/035409 | A1 | 5/2003 |

OTHER PUBLICATIONS

Japanese Office Action (Application No. 2010-178915) dated May 9, 2014 (with English translation).

Japanese Office Action (Application No. 2010-178915) dated Aug. 29, 2014 (with English translation).

Extended European Search Report (Application No. 14003049.5) dated Dec. 19, 2014.

Extended European Search Report (Application No. 14003074.3) dated Dec. 19, 2014.

European Search Report, European Patent Application No. 11816359, dated Feb. 10, 2014 (9 pages).

van Renesse, Rudolf L., "Optical Document Security," Third Edition, *Artech House*, Boston/London 2005 (7 pages).

Extended European Search Report (Application No. 16000347.1) dated May 3, 2016.

* cited by examiner

COMPARATIVE EXAMPLE
(WITHOUT OVERCOAT LAYER)

UV-A

UV-A

UV-C

UV-C

UV-A

LIGHT-EMITTING MEDIUM

FIELD OF THE INVENTION

The present invention relates to a light-emitting medium including a light-emitting image which appears when invisible light within a specific wavelength range is irradiated thereon.

BACKGROUND ART

In media such as valuable papers including cash vouchers and prepaid cards, identity cards including licenses, etc. which should be anti-counterfeit, there have been recently used a micro character, a copy guard pattern, an infrared-light absorbing ink, a fluorescent ink and so on, in order to improve security. The fluorescent ink is an ink including a fluorescent material which cannot be almost viewed under visible light, and can be viewed when invisible light (ultraviolet light or infrared light) is irradiated. With the use of such a fluorescent ink, there can be formed, on a valuable paper or the like, a fluorescent image (light-emitting image) which appears only when invisible light within a specific wavelength range is irradiated. Thus, it is possible to prevent that the valuable paper is easily forged by a generally used color printer or the like.

In addition, in order to further improve the anti-counterfeit effect, there is proposed that a light-emitting image, which cannot be viewed by the naked eye, is formed on a valuable paper by means of a fluorescent ink. For example, Patent Document 1 discloses a medium including a light-emitting image formed by using a first fluorescent ink and a second fluorescent ink. In this case, when seen with the naked eye, the first fluorescent ink and the second fluorescent ink are viewed as inks of the same color with each other, under visible light and ultraviolet light. On the other hand, when seen through a judging tool, the first fluorescent ink and the second fluorescent ink are viewed as inks of different colors from each other. Thus, the light-emitting image formed on the valuable paper cannot be easily forged, whereby the anti-counterfeit effect through the fluorescent inks can be enhanced. However, if there is a slight color difference or a thickness difference between the first fluorescent ink and the second fluorescent ink, there is a possibility that, when seen through the naked eye, the first fluorescent ink and the second fluorescent ink are not viewed as inks of the same color, whereby the light-emitting image is viewed.

Patent Document 1: JP4418881B

SUMMARY OF THE INVENTION

A procedure for judging whether a valuable paper is a counterfeit one or not is preferably performed easily and promptly. In addition, a valuable paper is preferably difficult to be forged. Thus, there is demand for a medium, which is difficult to be forged, by which whether a valuable paper is a counterfeit one or not can be easily and promptly judged by the naked eye, without using any tool such as a judging tool or the like.

The object of the present invention is to provide a light-emitting medium which is capable of effectively solving such a problem.

The present invention is a light-emitting medium including a light-emitting image on a substrate wherein: the light-emitting image includes a first area containing a first fluorescent material, a second area containing a second fluorescent material, and a protective layer formed on the first fluorescent material of the first area and the second fluorescent material of the second area; at least a part of the second area is adjacent to the first area; when invisible light within a first wavelength range is irradiated, the first fluorescent material and the second fluorescent material emit light of colors that are viewed as the same color with each other; and when invisible light within a second wavelength range is irradiated, the first fluorescent material and the second fluorescent material emit light of colors that are viewed as different colors from each other.

The present invention is a light-emitting medium including a light-emitting image on a substrate wherein: the light-emitting image includes a first area containing a first fluorescent material, a second area containing a second fluorescent material, and a protective layer formed on the first fluorescent material of the first area and the second fluorescent material of the second area; at least a part of the second area is adjacent to the first area; when invisible light within a first wavelength range is irradiated or when invisible light within a second wavelength range is irradiated, the first fluorescent material and the second fluorescent material emit light of colors that are viewed as the same color with each other; and when the invisible light within the first wavelength range and the invisible light within the second wavelength range are simultaneously irradiated, the first fluorescent material and the second fluorescent material emit light of colors that are viewed as different colors from each other.

The present invention is a light-emitting medium including a light-emitting image on a substrate wherein: the light-emitting image includes a first area containing a first fluorescent material, a second area containing a second fluorescent material, and a protective layer formed on the first fluorescent material of the first area and the second fluorescent material of the second area; at least a part of the second area is adjacent to the first area; when invisible light within a first wavelength range is irradiated, the first fluorescent material and the second fluorescent material emit light of colors that are viewed as different colors from each other; when invisible light within a second wavelength range is irradiated, the first fluorescent material and the second fluorescent material emit light of colors that are viewed as different colors from each other, the colors being different from the colors of the light viewed when the invisible light within the first wavelength range is irradiated; and when the invisible light within the first wavelength range and the invisible light within the second wavelength range are simultaneously irradiated, the first fluorescent material and the second fluorescent material emit light of colors that are viewed as the same color with each other.

In the light-emitting medium of the present invention, the protective layer may be made of a material that transmits therethrough the invisible light within the first wavelength range and the invisible light within the second wavelength range.

In the light-emitting medium of the present invention, the protective layer may contain an acrylic resin.

In the light-emitting medium of the present invention, the protective layer may be made of polymethyl methacrylate.

The present invention is a light-emitting medium including a light-emitting image on a substrate wherein: the light-emitting image includes a plurality of first pattern elements containing a first fluorescent material, a plurality of second pattern elements containing a second fluorescent material, and a protective layer formed on the substrate, the first pattern elements and the second pattern elements; the plurality of first pattern elements and the plurality of second pattern elements form a plurality of micro-characters; the plurality of micro-characters form micro-character rows, and the first pattern elements form a latent image in the micro-character rows; when invisible light within a first wavelength range is irradiated, the first fluorescent material and the second fluorescent material emit light of colors that are viewed as the same color with each other; and when invisible light within a second wavelength range is irradiated, the first fluorescent material and the second fluorescent material emit light of colors that are viewed as different colors from each other, whereby the latent image in the micro-character rows is caused to appear.

The present invention is a light-emitting medium including a light-emitting image on a substrate wherein: the light-emitting image includes a plurality of first pattern elements containing a first fluorescent material, a plurality of second pattern elements containing a second fluorescent material, and a protective layer formed on the substrate, the first pattern elements and the second pattern elements; the plurality of first pattern elements and the plurality of second pattern elements form a plurality of micro-characters; the plurality of micro-characters form micro-character rows, and the first pattern elements form a latent image in the micro-character rows; when invisible light within a first wavelength range is irradiated or when invisible light within a second wavelength range is irradiated, the first fluorescent material and the second fluorescent material emit light of colors that are viewed as the same color with each other; and when the invisible light within the first wavelength range and the invisible light within the second wavelength range are simultaneously irradiated, the first fluorescent material and the second fluorescent material emit light of colors that are viewed as different colors from each other, whereby the latent image in the micro-character rows is caused to appear.

The present invention is a light-emitting medium including a light-emitting image on a substrate wherein: the light-emitting image includes a plurality of first pattern elements containing a first fluorescent material, a plurality of second pattern elements containing a second fluorescent material, and a protective layer formed on the substrate, the first pattern elements and the second pattern elements; the plurality of first pattern elements and the plurality of second pattern elements form a plurality of micro-characters; the plurality of micro-characters form micro-character rows, and the first pattern elements form a latent image in the micro-character rows; when invisible light within a first wavelength range is irradiated, the first fluorescent material and the second fluorescent material emit light of colors that are viewed as different colors from each other, whereby the latent image in the micro-character rows is caused to appear; when invisible light within a second wavelength range is irradiated, the first fluorescent material and the second fluorescent material emit light of colors that are viewed as different colors from each other, the colors being different from the colors of the light viewed when the invisible light within the first wavelength range is irradiated, whereby the latent image in the micro-character rows is caused to appear; and when the invisible light within the first wavelength range and the invisible light within the second wavelength range are simultaneously irradiated, the first fluorescent material and the second fluorescent material emit light of colors that are viewed as the same color with each other.

In the light-emitting medium of the present invention, the protective layer may be made of a material that transmits therethrough the invisible light within the first wavelength range and the invisible light within the second wavelength range.

In the light-emitting medium of the present invention, the protective layer may contain an acrylic resin.

In the light-emitting medium of the present invention, the protective layer may be made of polymethyl methacrylate.

According to the light-emitting medium of the present invention, the light-emitting image can be confirmed easily and promptly.

Further, the pattern of the light-emitting image can be prevented from being easily found out, whereby forging of the light-emitting medium can be made more difficult.

DETAILED DESCRIPTION OF THE INVENTION

A first embodiment the present invention will described herebelow with reference to FIGS. 1 to 6B. At first, an anti-counterfeit medium 10 made of a light-emitting medium of the present invention is described as a whole with reference to FIGS. 1 to 3.

Anti-Counterfeit Medium

Figure 1:
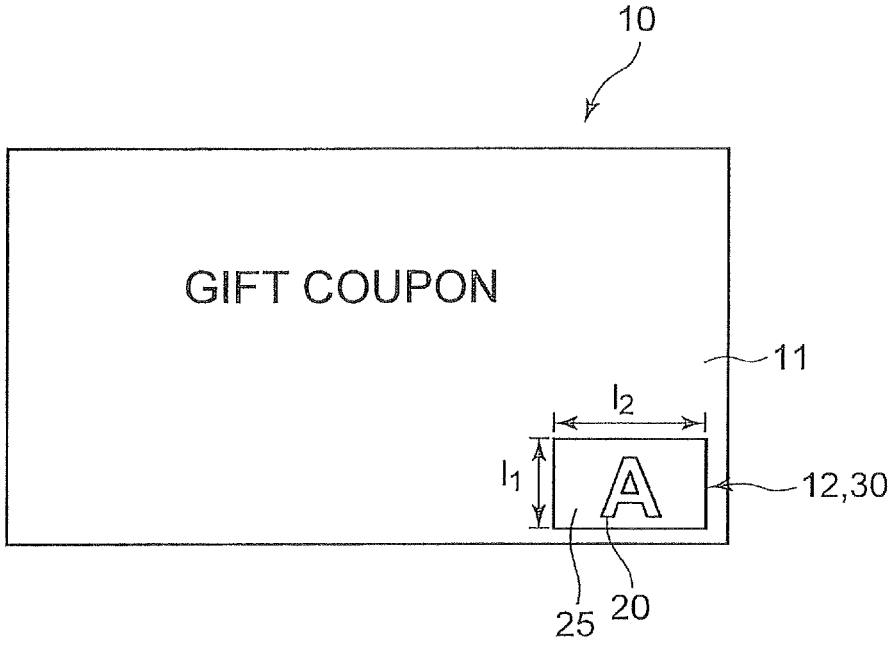
FIG. 1 is a plan view showing an example of a valuable paper constituted by an anti-counterfeit medium made of a light-emitting medium of the present invention.

FIG. 1 is a view showing an example of a gift coupon (valuable paper) constituted by the anti-counterfeit medium 10 according to this embodiment. As shown in FIG. 1, the anti-counterfeit medium 10 includes a substrate 11 and a light-emitting image 12 formed on the substrate 11. In this embodiment, as described below, the light-emitting image 12 functions as an authenticity judging image for judging authenticity of the anti-counterfeit medium 10. As shown in FIG. 1, the light-emitting image 12 is composed of a pattern area (first area) 20 and a background area (second area) 25 formed to be adjacent to the pattern area 20. In the example shown in FIG. 1, the pattern area 20 is formed of a character (pattern) of "A", and the background area 25 is formed to surround the pattern area 20. As described below, the respective areas 20 and 25 are formed by printing fluorescent inks that are excited by invisible light to emit fluorescent light. In addition, as described below, an overcoat layer (protective layer) 30 is formed on a surface of the light-emitting image 12. The overcoat layer 30 is substantially achromatic and transparent.

A material of the substrate 11 used in the anti-counterfeit medium 10 is not specifically limited, and the material is suitably selected depending on a type of a valuable paper constituted by the anti-counterfeit medium 10. For example, as a material of the substrate 11, there is used white polyethylene terephthalate having excellent printability and processability. A thickness of the substrate 11 is suitably set depending on a type of a valuable paper constituted by the anti-counterfeit medium 10.

A size of the light-emitting image 12 is not specifically limited, and the size is suitably set depending on easiness in authenticity judgment and required judgment precision. For example, a length $l_1$ and a length $l_2$ of the light-emitting image 12 are within a range of 1 to 210 mm and a range of 1 to 300 mm, respectively.

Light-Emitting Image

Figure 2:
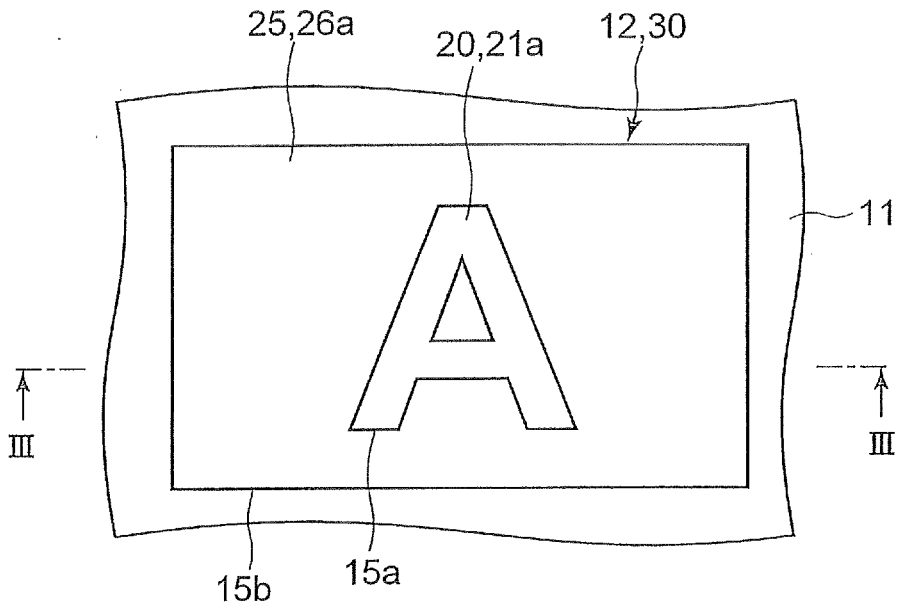
FIG. 2 is a plan view of the light-emitting image of the anti-counterfeit medium in a first embodiment of the present invention.
Figure 3:
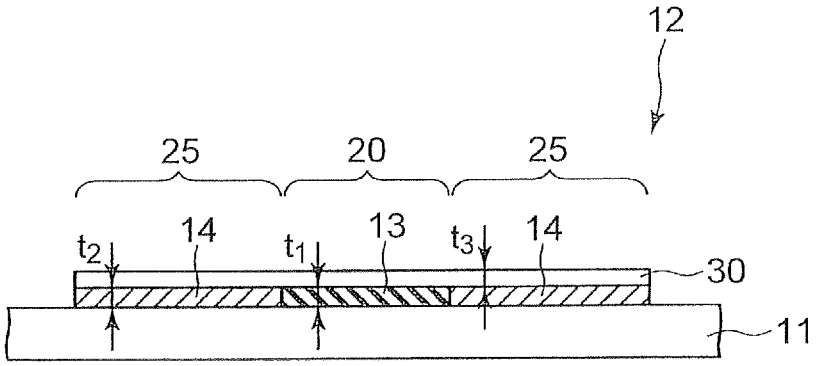
FIG. 3 is a sectional view taken along a line of the light-emitting image shown in FIG. 2.

Next, the light-emitting image 12 is described in more detail with reference to FIGS. 2 and 3. FIG. 2 is a plan view showing the light-emitting image 12 in enlargement under visible light. FIG. 3 is a sectional view taken along a line III-III of the light-emitting image 12 shown in FIG. 2.

Referring firstly to FIG. 3, a structure of the light-emitting image 12 is described. As shown in FIG. 3, the pattern area 20 of the light-emitting image 12 and the background area 25 thereof are formed by solid-printing a first fluorescent ink 13 and a second fluorescent ink 14 on the substrate 11. The overcoat layer 30 is formed by, e.g., screen-printing an overcoat ink on the first fluorescent ink 13 of the pattern area 20 and the second fluorescent ink 14 of the background area 25.

FIG. 3 shows the example in which the first fluorescent ink 13 of the pattern area 20 and the second fluorescent ink 14 of the background area 25 are in contact with each other. However, not limited thereto, a gap, which cannot be viewed by the naked eye, may be defined between the first fluorescent ink 13 of the pattern area 20 and the second fluorescent ink 14 of the background area 25. Alternatively, between the first fluorescent ink 13 of the pattern area 20 and the second fluorescent ink 14 of the background area 25, the first fluorescent ink 13 and the second fluorescent ink 14 may be overlapped with each other.

A thickness $t_1$ of the first fluorescent ink 13 and a thickness $t_2$ of the second fluorescent ink 14 are suitably set depending on a type of a valuable paper, a printing method and so on. For example, the thickness $t_1$ is within a range of 0.3 to 100 μm, and the thickness $t_2$ is within a range of 0.3 to 100 μm. Preferably, the thickness $t_1$ and the thickness $t_2$ are substantially the same with each other. Due to this structure, a boundary between the pattern area 20 and the background area 25 can be restrained from being viewed, which might be caused by a difference between the thickness of the first fluorescent ink 13 and the thickness of the second fluorescent ink 14.

A surface roughness of the first fluorescent ink 13 and the second fluorescent ink 14 and a thickness $t_3$ of the overcoat layer 30 are described.

An arithmetical mean roughness Ra (herebelow referred to as roughness Ra) of a surface of a film made of general polyethylene terephthalate or the like, which is used for the substrate 11 in this embodiment, is within a range between 0.01 μm and 0.1 μm. A roughness Ra of a surface of a matted film made of polyethylene terephthalate or the like is within a range between 0.1 μm and 0.5 μm. Alternatively, a sheet of paper may be used as the substrate 11. In the case of paper, a roughness Ra of a surface of a paper sheet for picture is within a range between 0.05 μm and 0.5 μm, and a roughness Ra of a surface of a general paper sheet is within a range between 2 μm and 3 μm. Thus, when a thickness of the first fluorescent ink 13 and a thickness of the second fluorescent ink 14 are small, a value of the surface roughness Ra of the first fluorescent ink 13 and the second fluorescent ink 14 is close to a surface roughness Ra of a material used as the substrate 11. On the other hand, when a thickness of the first fluorescent ink 13 and a thickness of the second fluorescent ink 14 are large, a value of the surface roughness Ra of the first fluorescent ink 13 and the second fluorescent ink 14 is considered to be caused by irregularities of the inks themselves.

Thus, the thickness $t_3$ of the overcoat layer 30 is suitably set depending on the surface roughness Ra of the substrate 11 and the surface roughness Ra of the first fluorescent ink 13 and the second fluorescent ink 14. For example, the thickness $t_3$ of the overcoat layer 30 is within a range between 0.01 μm and 100 μm.

As described below, the first fluorescent ink 13 and the second fluorescent ink 14 respectively contain predetermined fluorescent materials, such as particulate pigments, which do not emit light under visible light and emit light under specific invisible light. Herein, for example, a particle diameter of the pigments contained in the inks 13 and 14 is within a range of 0.1 to 10 μm, preferably within a range of 0.1 to 3 μm. Thus, when the visible light is irradiated on the inks 13 and 14, the light is scattered by the pigment particles. As described above, the overcoat layer 30 is substantially achromatic and transparent. Therefore, as shown in FIG. 2, when the light-emitting image 12 is seen under the visible light, a white pattern area 21*a* is viewed as the pattern area 20, and a white background area 26*a* is viewed as the background area 25. As described above, the substrate 11 is made of white polyethylene terephthalate. For this reason, all of the substrate 11, the pattern area 20 of the light-emitting image 12 and the background area 25 thereof are viewed areas of white color. As a result, the pattern of the pattern area 20 of the light-emitting image 12 will not appear under the visible light. Accordingly, it is possible to prevent that the anti-counterfeit medium 10 including the light-emitting image 12 is easily forged.

In FIG. 2, a first boundary line 15*a* between the pattern area 20 and the background area 25 and a second boundary line 15*b* between the substrate 11 and the light-emitting image 12 are drawn as a matter of convenience. Under the visible light, the first boundary line 15*a* and the second boundary line 15*b* cannot be actually viewed.

Fluorescent Inks

Figure 4A:
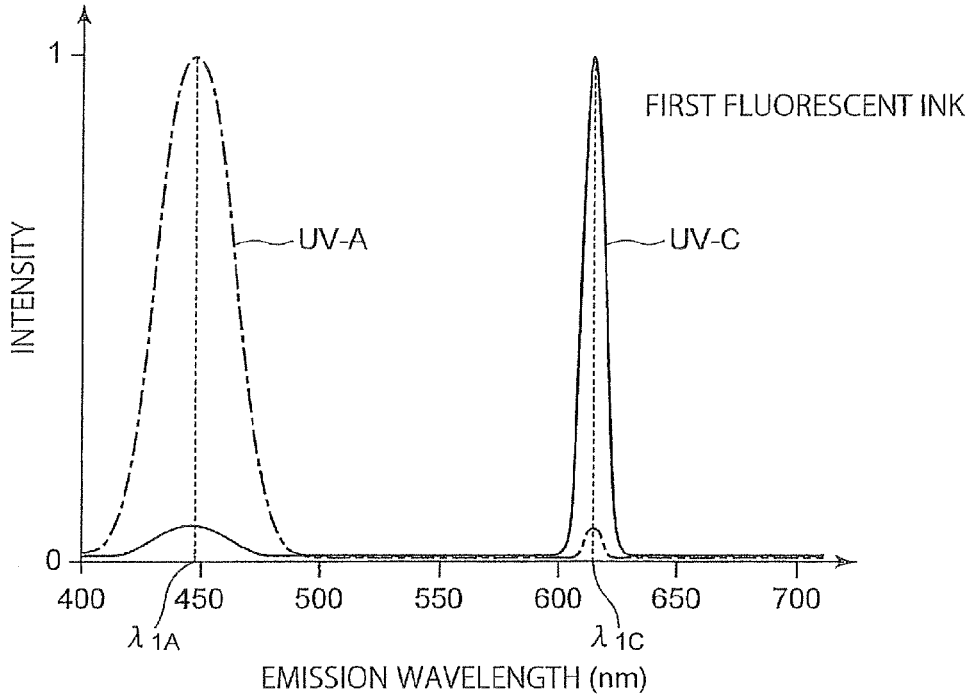
FIG. 4A is a view showing a fluorescence emission spectrum of a first fluorescent ink in the first embodiment of the present invention.
Figure 4B:
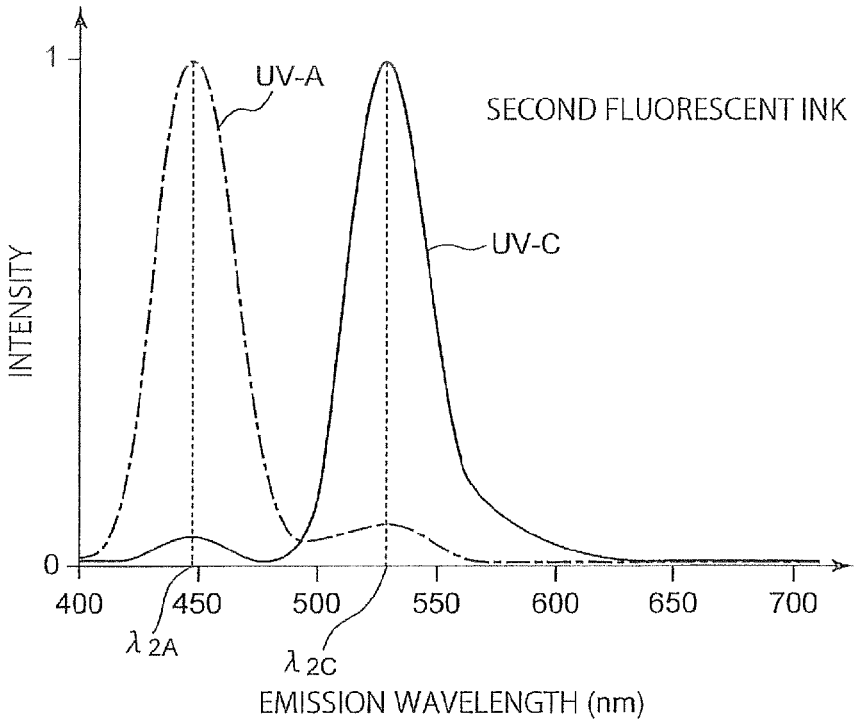
FIG. 4B is a view showing a fluorescence emission spectrum of a second fluorescent ink in the first embodiment of the present invention.
Figure 5:
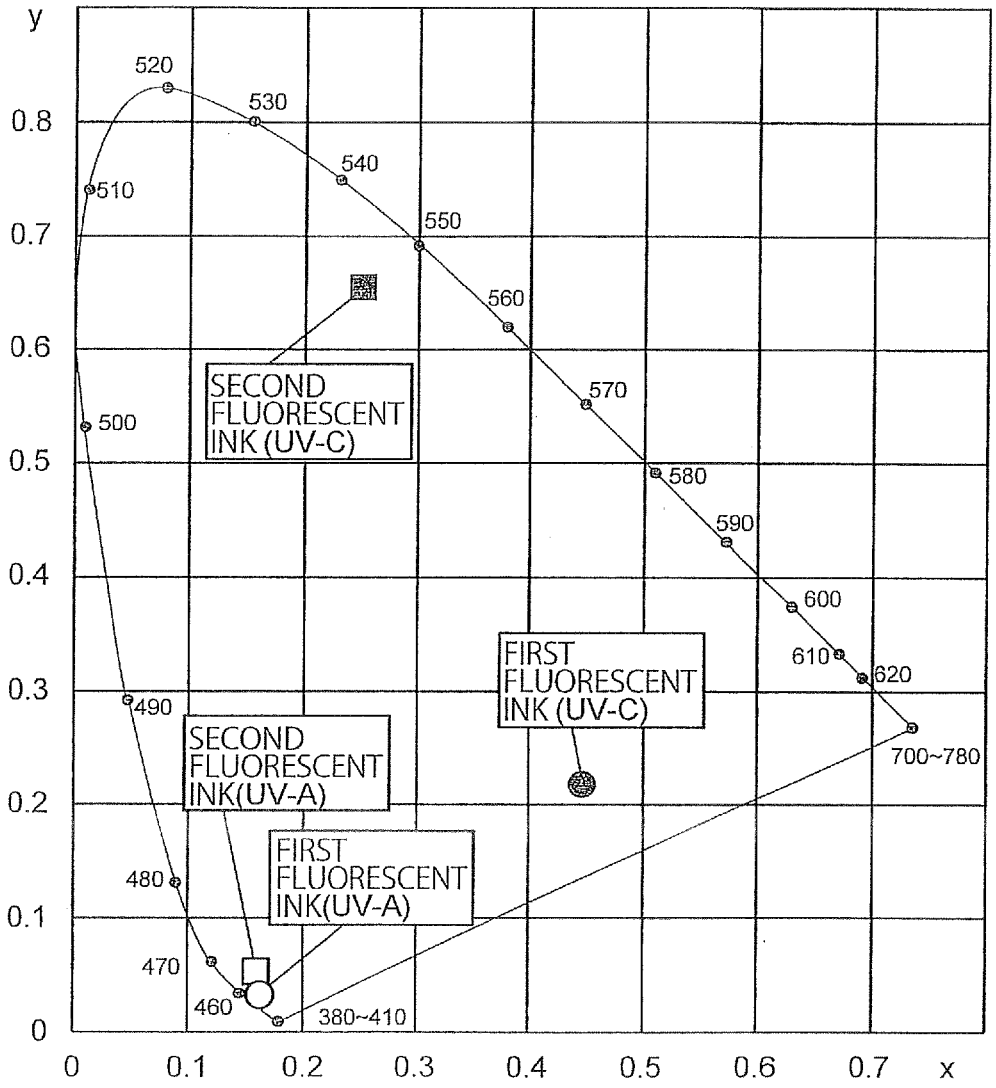
FIG. 5 is an xy chromaticity diagram showing chromaticities of fluorescent light emitted from the first fluorescent ink and chromaticities of fluorescent light emitted from the second fluorescent ink, in the first embodiment of the present invention.

Next, the first fluorescent ink 13 and the second fluorescent ink 14 are described in more detail with reference to FIGS. 4A to 5. FIG. 4A is a view showing a fluorescence emission spectrum of the first fluorescent ink 13, and FIG. 4B is a view showing a fluorescence emission spectrum of the second fluorescent ink 14. FIG. 5 is an xy chromaticity diagram showing, by means of an XYZ colorimetric system, chromaticities of light emitted from the first fluorescent ink 13 and chromaticities of light emitted from the second fluorescent ink 14, when light within a specific wavelength range is irradiated.

(First Fluorescent Ink)

The first fluorescent ink 13 is firstly described. In FIG. 4A, the one-dot chain lines show the fluorescence emission spectrum of the first fluorescent ink 13, when ultraviolet light (invisible light) within a wavelength range of 315 to 400 nm (within a first wavelength range), i.e., so-called UV-A is irradiated. The solid line shows the fluorescence emission spectrum of the first fluorescent ink 13, when ultraviolet light (invisible light) within a wavelength range of 200 to 280 nm (within a second wavelength range), i.e., so-called UV-C is irradiated. Each fluorescence emission spectrum shown in FIG. 4A is normalized such that a peak intensity at the maximum peak is 1.

As shown in FIG. 4A, when the UV-A is irradiated, the first fluorescent ink 13 emits light having a peak wavelength $\lambda_{1A}$ of about 445 nm, which is light of blue color (first color). On the other hand, when the UV-C is irradiated, the first fluorescent ink 13 emits light having a peak wavelength $\lambda_{1C}$ of about 610 nm, which is light of red color (second color). Namely, the first fluorescent ink 13 contains a so-called dichromatic fluorescent material (first fluorescent material) which emits light of color which differs from when the UV-A is irradiated to when the UV-C is irradiated. Such a dichromatic fluorescent material can be obtained by suitably combining, e.g., a fluorescent material that is excited by the UV-A and a fluorescent material that is excited by the UV-C (see, for example, JP10-251570A).

As shown in FIG. 4A, when the UV-A is irradiated, light having a wavelength of about 610 nm is also emitted. However, the light having a wavelength of about 610 nm has an intensity that is smaller than an intensity of the light having a peak wavelength $\lambda_{1A}$ of about 445 nm. Thus, when the UV-A is irradiated, the light emitted from the first fluorescent ink 13 is viewed as light of blue color. Similarly, as shown in FIG. 4A, when the UV-C is irradiated, although the light having a wavelength of about 445 nm is emitted, since an intensity thereof is small, the light emitted from the first fluorescent ink 13 is viewed as light of red color.

(Second Fluorescent Ink)

Next, the second fluorescent ink 14 is described. In FIG. 4B, the one-dot chain lines show the fluorescence emission spectrum of the second fluorescent ink 14 when the UV-A is irradiated. The solid line shows the fluorescence emission spectrum of the second fluorescent ink 14 when the UV-C is irradiated. Similarly to the case shown in FIG. 4A, each fluorescence emission spectrum shown in FIG. 4B is normalized such that a peak intensity at the maximum peak is 1.

As shown in FIG. 4B, when the UV-A is irradiated, the second fluorescent ink 14 emits light having a peak wavelength $\lambda_{2A}$ of about 445 nm, which is light of blue color (first color), or light of a color that is viewed as the same color as the blue color (first color). On the other hand, when the UV-C is irradiated, the second fluorescent ink 14 emits light having a peak wavelength $\lambda_{2C}$ of about 525 nm, which is light of green color (third color). Namely, similarly to the first fluorescent ink 13, the second fluorescent ink 14 contains a so-called dichromatic fluorescent material (second fluorescent material) which emits light of color which differs from when the UV-A is irradiated to when the UV-C is irradiated.

As shown in FIG. 4B, when the UV-A is irradiated, light having a wavelength of about 525 nm is also emitted. However, the light having a wavelength of about 525 nm has an intensity that is smaller than an intensity of the light having a peak wavelength $\lambda_{2A}$ of about 445 nm. Thus, when the UV-A is irradiated, the light emitted from the second fluorescent ink 14 is viewed as light of blue color. Similarly, as shown in FIG. 4B, when the UV-C is irradiated, light having a wavelength of about 445 nm is also emitted. However, since an intensity thereof is small, the light from the second fluorescent ink 14 is viewed as light of green color.

Next, chromaticities of light emitted from the first fluorescent ink 13 and the second fluorescent ink 14 upon irradiation of the UV-A or the UV-C are described in more detail with reference to FIG. 5. As to symbols shown in FIG. 5, a blank circle represents a chromaticity of light emitted from the first fluorescent ink 13 upon irradiation of the UV-A, and a blank square represents a chromaticity of light emitted from the second fluorescent ink 14 upon irradiation of the UV-A. A black circle represents a chromaticity of light emitted from the first fluorescent ink 13 upon irradiation of the UV-C, and a black square represents a chromaticity of light emitted from the second fluorescent ink 14 upon irradiation of the UV-C.

The aforementioned blue color (first color) corresponds to the chromaticity represented by the blank circle shown in FIG. 5. The aforementioned red color (second color) corresponds to the chromaticity represented by the black circle shown in FIG. 5. The aforementioned green color (third color) corresponds to the black square in FIG. 5.

As shown in FIG. 5, in the xy chromaticity diagram, the chromaticity of the light emitted from the first fluorescent ink 13 upon irradiation of the UV-A and the chromaticity of the light emitted from the second fluorescent ink 14 upon irradiation of the UV-A are close to each other. Thus, as described above, the light emitted from the second fluorescent ink 14 when the UV-A is irradiated is viewed as light of a color that is the same as the color of the light emitted from the first fluorescent ink 13 upon irradiation of the UV-A. Thus, the pattern area 20 formed with the use of the first fluorescent ink 13 and the background area 25 formed with the use of the second fluorescent ink 14 are viewed as areas of the same color, upon irradiation of the UV-A. As a result, as described below, upon irradiation of the UV-A, the overall light-emitting image 12 is viewed as an image of a monochromic color (blue color), and thus the pattern of the pattern area 20 does not appear.

On the other hand, as shown in FIG. 5, in the xy chromaticity diagram, the chromaticity of light emitted from the first fluorescent ink 13 upon irradiation of the UV-C and the chromaticity of the light emitted from the second fluorescent ink 14 upon irradiation of the UV-C are greatly distant from each other. Thus, the light emitted from the second fluorescent ink 14 when the UV-C is irradiated is viewed as light of a color that is different from the color of the light emitted from the first fluorescent ink 13 upon irradiation of the UV-C. Thus, the pattern area 20 formed with the use of the first fluorescent ink 13 and the background area 25 formed with the use of the second fluorescent ink 14 are viewed as areas of different colors, upon irradiation of the UV-C. As a result, as described below, upon irradiation of the UV-C, the pattern of the pattern area 20 can be viewed.

In the present invention, the "same color" means that chromaticities of two colors are so close to each other that the difference in colors cannot be discriminated by the naked eye. To be more specific, the "same color" means that a color difference $\Delta E^*_{ab}$ between two colors is not more than 10, preferably not more than 3. The "different colors" means that the color difference $\Delta E^*_{ab}$ between the two colors is greater than 10. The color difference $\Delta E^*_{ab}$ is a value that is calculated based on L*, a* and b* in an L*a*b* colorimetric system, and is a value as a reference relating to a difference in colors when observed by the naked eye. L*, a* and b* in the L*a*b* colorimetric system and tristimulus values X, Y and Z in an XYZ colorimetric system are calculated based on a light spectrum and so on. There is a relationship according to a well-known transformation among L*, a* and b*, and the tristimulus values X, Y and Z.

The above tristimulus values can be measured by using, a measuring device such as a spectrophotometer, a differential colorimeter, a chromatometer, a colorimeter, a chromoscope, etc. Among these measuring devices, since the spectrophotometer can obtain a spectrum reflectance of each wavelength, the spectrophotometer can precisely measure the tristimulus values and thus is suited for analysis of color difference.

A procedure for calculating a color difference $\Delta E^*_{ab}$ is as follows. For example, light from a plurality of media (inks) to be compared is measured by the spectrophotometer in the first place, and then the tristimulus values X, Y and Z or L*, a* and b* are calculated based on the result. Thereafter, a color difference is calculated from differences ΔL*, Δa* and Δb* of L*, a* and b* in the plurality of media (inks), based on the following expression.

$$\Delta E^*_{ab}=[(\Delta L^*)^2+(\Delta a^*)^2+(\Delta b^*)^2]^{1/2} \quad \text{Expression 1}$$

Next, an operation of this embodiment as structured above is described. Herein, a method of manufacturing the anti-counterfeit medium 10 is firstly described. Then, there is described a method of examining whether a valuable paper made of the anti-counterfeit medium 10 is genuine or not.

Method of Manufacturing Anti-counterfeit Medium

At first, the substrate 11 is prepared. As the substrate 11, there is used a 188-μm thick substrate made of white polyethylene terephthalate. Then, by using the first fluorescent ink 13 and the second fluorescent ink 14, the light-emitting image 12 composed of the pattern area 20 and the background area 25 is formed on the substrate 11.

At this time, as the first fluorescent ink 13 and the second fluorescent ink 14, there are used offset lithographic inks each of which is obtained by, for example, adding 8 wt % of microsilica, 2 wt % of organic bentonite, 50 wt % of alkyd resin and 15 wt % of alkyl benzene-based solvent, to 25 wt % of dichromatic fluorescent material having predetermined fluorescent properties. As the dichromatic material (first fluorescent material) for the first fluorescent ink 13, there is used a fluorescent material DE-RB (manufactured by Nemoto Co., Ltd.) which emits light of red color when being excited by ultraviolet light having a wavelength of 254 nm, and emits light of blue color when being excited by ultraviolet light having a wavelength of 365 nm. As the dichromatic material (second fluorescent material) for the second fluorescent ink 14, there is used a fluorescent material DE-GB (manufactured by Nemoto Co., Ltd.) which emits light of green color when being excited by ultraviolet light having a wavelength of 254 nm, and emits light of blue color when being excited by ultraviolet light having a wavelength of 365 nm.

The dichromatic fluorescent materials of the first fluorescent ink 13 and the second fluorescent ink 14 are respectively selected such that, when ultraviolet light having a wavelength of 365 nm is irradiated, a color difference $\Delta E^*_{ab}$ between the light of blue color emitted from the first fluorescent ink 13 and the light of blue color emitted from the second fluorescent ink 14 is not more than 10, preferably not more than 3. In general, the color difference $\Delta E^*_{ab}$ of about 3 is a limit of recognition ability of the human eye, i.e., ability of discriminating colors. Thus, when the color difference $\Delta E^*_{ab}$ is not ore than 3, it becomes more difficult to discriminate colors by the naked eye, whereby the pattern of the light-emitting image 12 for judging authenticity can be prevented from being easily found out.

The composition of the respective constituent elements of the first fluorescent ink 13 and the second fluorescent ink 14 is not limited to the aforementioned composition, and an optimum composition can be set according to properties required for the anti-counterfeit medium 10.

Thereafter, with the use of an overcoat ink, the overcoat layer 30 having a thickness of, e.g., 2 μm is formed by screen-printing the overcoat ink on the first fluorescent ink 13 of the pattern area 20 and the second fluorescent ink 14 of the background area 25. At this time, as the overcoat ink, a screen ink obtained by, for example, adding 33 wt % of methyl ethyl ketone to 67 wt % of polymethyl methacrylate as an acrylic resin.

The acrylic resin is a highly transparent synthetic resin, meaning polymer of acrylic ester or methacrylic ester. The overcoat layer 30 in the present invention is required to transmit therethrough ultraviolet light from the UV-A to UV-C and light having a wavelength of visible light range, which is emitted upon irradiation of ultraviolet light from the UV-A to UV-C. Thus, an acrylic resin having a wide transmission wavelength range is suited for the overcoat layer 30.

In particular, since polymethyl methacrylate transmits therethrough light of visible light wavelength, ultraviolet light having a wavelength of 365 nm and ultraviolet light having a wavelength of 254 nm, polymethyl methacrylate is suited for the present invention.

The overcoat ink thus manufactured can transmit therethrough ultraviolet light having a wavelength of 254 nm and ultraviolet light having a wavelength of 365 nm.

The overcoat layer 30 may be formed by various printing methods including the aforementioned screen printing. However, not limited thereto, a lamination method, a thermal transfer method, etc. may be used.

Confirmation Method

Next, a method of examining (confirming) whether a valuable paper made of the anti-counterfeit medium 10 is genuine or not is described with reference to FIGS. 2, 6A and 6B.

(Case of Irradiating Visible Light)

At first, the anti-counterfeit medium 10 is observed under visible light. In this case, as described above, the substrate 11, the first pattern area 20 of the light-emitting image 12 and the background area 25 thereof are respectively viewed as areas of white color (see FIG. 2). Thus, under the visible light, the pattern of the first pattern area 20 of the light-emitting image 12 does not appear.

(Case of Irradiation of UV-A)

Then, the anti-counterfeit medium 10 when the UV-A is irradiated thereon is observed. As the UV-A to be irradiated, ultraviolet light having a wavelength of 365 nm is used, for example. The UV-A transmits through the overcoat layer 30 to reach the first fluorescent ink 13 forming the pattern area 20 and the second fluorescent ink 14 forming the background area 25.

Figure 6A:
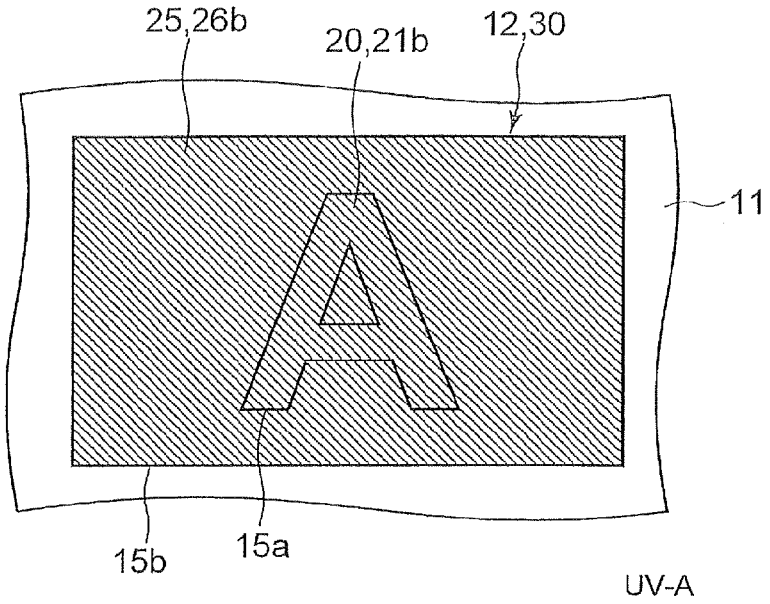
FIG. 6A is a plan view showing the light-emitting image when UV-A is irradiated thereon, in the first embodiment of the present invention.

FIG. 6A is a plan view showing the light-emitting image of the anti-counterfeit medium 10, when the UV-A is irradiated thereon. Since the first fluorescent ink 13 forming the pattern area 20 contains the fluorescent material DE-RB, the first fluorescent ink 13 emits light of blue color. Thus, the pattern area 20 is viewed as a blue portion 21*b*. On the other hand, since the second fluorescent ink 14 forming the background area 25 contains the fluorescent material DE-GB, the second fluorescent ink 14 emits light of blue color. Thus, the background area 25 is viewed as a blue portion 26*b*. Even when there is difference in thickness and/or surface roughness between the first fluorescent ink 13 of the pattern area 20 and the second fluorescent ink 14 of the background area 25, the overcoat layer 30 obscures such a difference, whereby the blue portion 21*b* and the blue portion 26*b* are viewed as portions of the same color. Namely, when the UV-A is irradiated, the pattern area 20 and the background area 25 are viewed as areas of the same color. As a result, when the UV-A is irradiated, the pattern of the pattern area 20 of the light-emitting image 12 does not appear.

(Case of Irradiation of UV-C)

Then, the anti-counterfeit medium 10 when the UV-C is irradiated thereon is observed. As the UV-C to be irradiated, ultraviolet light having a wavelength of 254 nm is used, for example. The UV-C transmits through the overcoat layer 30 to reach the first fluorescent ink 13 forming the pattern area 20 and the second fluorescent ink 14 forming the background area 25.

Figure 6B:
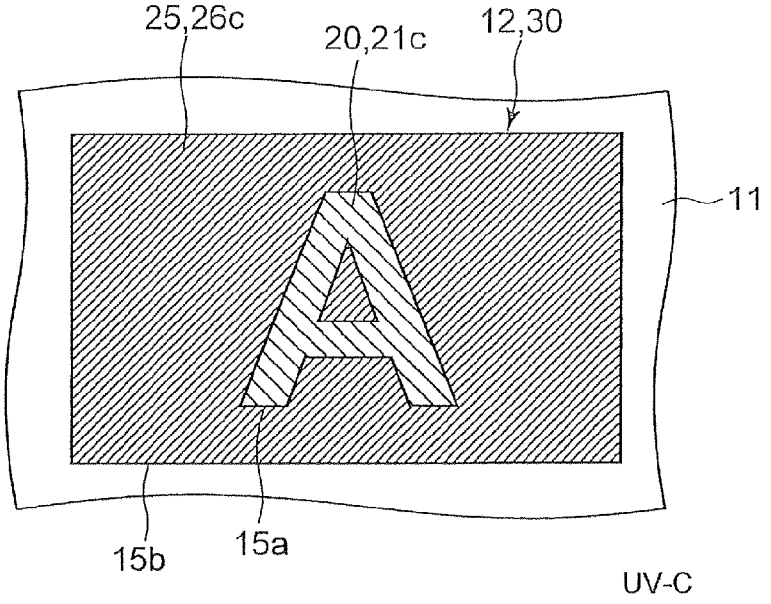
FIG. 6B is a plan view showing the light-emitting image when UV-C is irradiated thereon, in the first embodiment of the present invention.

FIG. 6B is a plan view showing the light-emitting image of the anti-counterfeit medium 10 when the UV-C is irradiated thereon. Since the first fluorescent ink forming the pattern area 20 contains the fluorescent material DE-RB, the first fluorescent ink 13 emits light of red color. Thus, the pattern area 20 is viewed as a red portion 21*c*. On the other hand, since the second fluorescent ink forming the background area 20 contains the fluorescent material DE-GB, the second fluorescent ink 14 emits light of green color. Thus, the background area 25 is viewed as green portion 26*c*. Namely, when the UV-C is irradiated, the pattern area 20 and the background area 25 are viewed as areas of different colors. As a result, when the UV-C is irradiated, the pattern of the pattern area 20 of the light-emitting image 12 is viewed.

By checking the colors of the pattern area 20 and the background area 25 vary as described above when the visible light is irradiated, the UV-A is irradiated and the UV-C is irradiated, whether the valuable paper made of the anti-counterfeit medium 10 is genuine or not can be confirmed.

Comparative Example

The light-emitting image 12 not including the overcoat layer 30 is described as a comparative example.

Figure 6C:
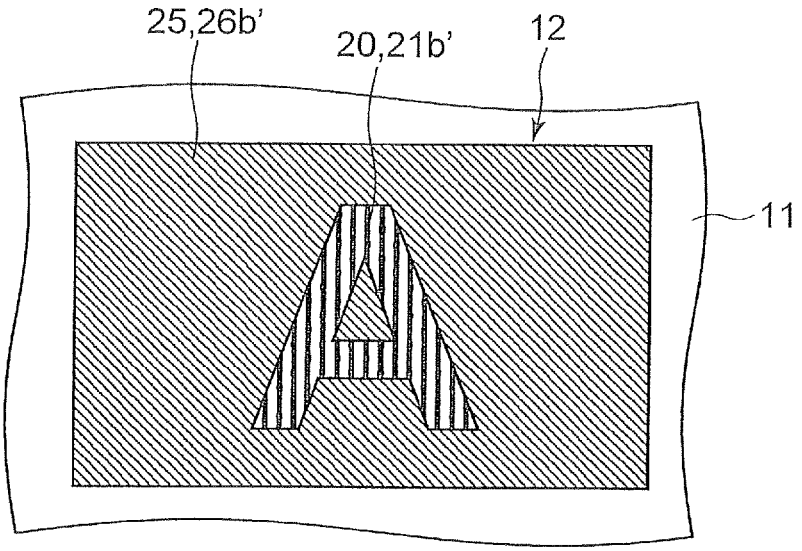
FIG. 6C is a plan view showing the light-emitting image when the UV-A is irradiated thereon, in a comparative example.

FIG. 6C is a plan view showing the light-emitting image 12 of the anti-counterfeit medium 10 when the UV-A is irradiated thereon, in the comparative example. The light-emitting image 12 of the anti-counterfeit medium 10 differs from the structure shown in FIGS. 2 and 3 in that this light-emitting image 12 does not include the overcoat layer 30. Since the other structures are the same as those of FIGS. 2 and 3, description thereof is omitted. There is a difference in thickness and/or surface roughness between the pattern area 20 of the light-emitting image 12 and the background area 25 thereof. Similarly to the first embodiment, when the UV-A is irradiated, the pattern area 20 is viewed as a blue portion 21*b*'. The background area 25 is also viewed as a blue portion 26*b*'. However, because of the difference in thickness and/or surface roughness between the pattern area 20 and the background area 25, a color difference between the blue portion 21*b*' and the blue portion 26*b*' is so large that the blue portion 21*b*' and the blue portion 26*b*' are viewed as portions of different colors. Thus, the character "A" is viewed.

Modification Example

In this embodiment, there is described the example in which the pattern area 20 of the light-emitting image 12 and the background area 25 thereof are formed on the substrate 11 by solid-printing thereon the first fluorescent ink 13 containing the first fluorescent material and the second fluorescent ink 14 containing the second fluorescent material. However, not limited thereto, the pattern area 20 and the background area 25 may be formed by printing, on the substrate 11, the first fluorescent ink 13 containing the first fluorescent material and the second fluorescent ink 14 containing the second fluorescent material in an identical predetermined pattern. Herebelow, the first fluorescent ink 13 and the second fluorescent ink 14 are printed in a striped pattern on the substrate 11 with reference to FIGS. 7 to 9B.

Figure 7:
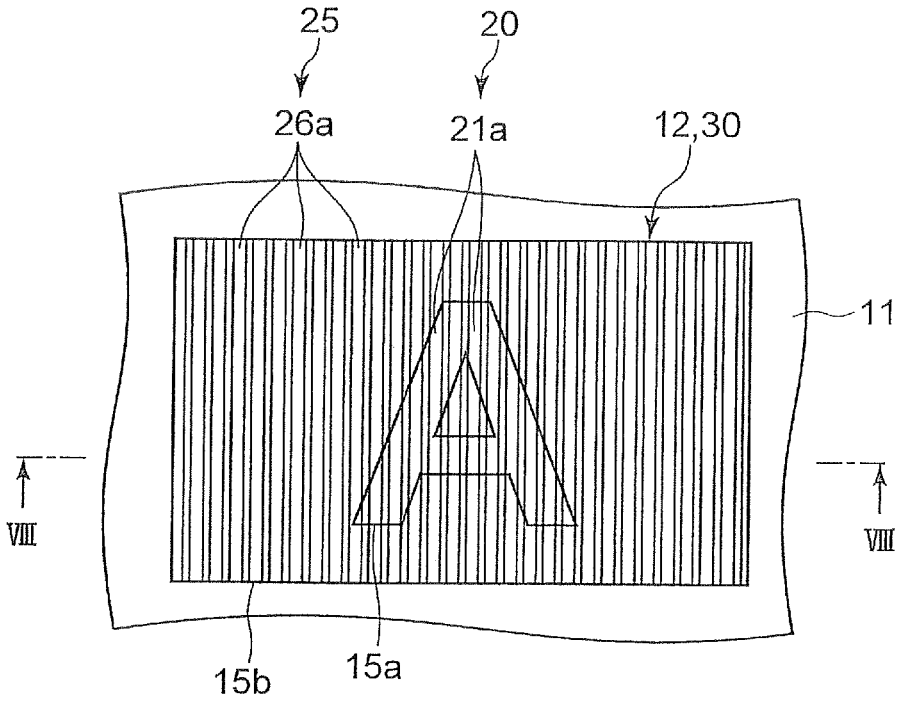
FIG. 7 is a plan view showing the light-emitting image of the anti-counterfeit medium, in a modification example of the first embodiment of the present invention.
Figure 8:
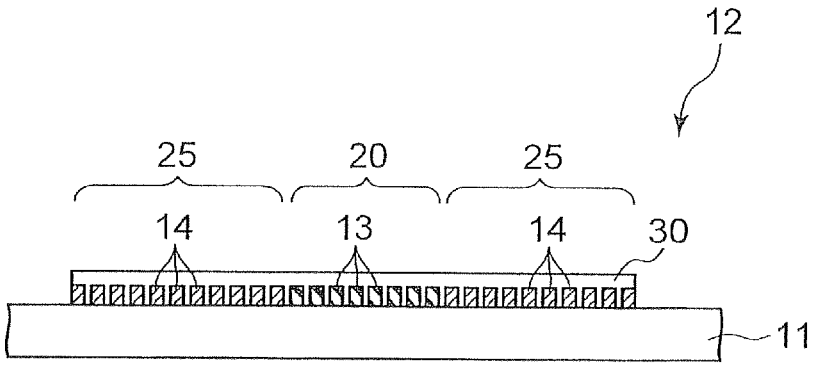
FIG. 8 is a sectional view taken along a line VIII-VIII of the light-emitting image shown in FIG. 7.

FIG. 7 is a plan view showing the light-emitting image 12 of the anti-counterfeit medium 10 under visible light, in this modification example. FIG. 8 is a sectional view taken along a line VIII-VIII of the light-emitting image 12 shown in FIG. 7. As shown in FIGS. 7 and 8, in this modification example, the pattern area 20 and the background area 25 are formed by printing, on the substrate 11, the first fluorescent ink 13 and the second fluorescent ink 14 in a striped pattern. In addition, the overcoat layer 30 is formed on the first fluorescent ink 13 of the pattern area 20, the second fluorescent ink 14 of the background area 25, and a portion of the substrate 11 exposed outside the pattern area 20 and the background area 25.

Next, a method of examining whether a valuable paper formed of the anti-counterfeit medium 10 is genuine or not in this modification example is described with reference to FIGS. 7 and 9A and 9C.

(Case of Irradiation of Visible Light)

Under visible light, as shown in FIG. 7, the pattern area 20 and the background area 25 are formed of white portions 21*a* and 26*a* that are positioned in a striped pattern. Thus, under the visible light, the pattern of the pattern area 20 of the light-emitting image 12 does not appear.

(Case of Irradiation of UV-A)

Figure 9A:
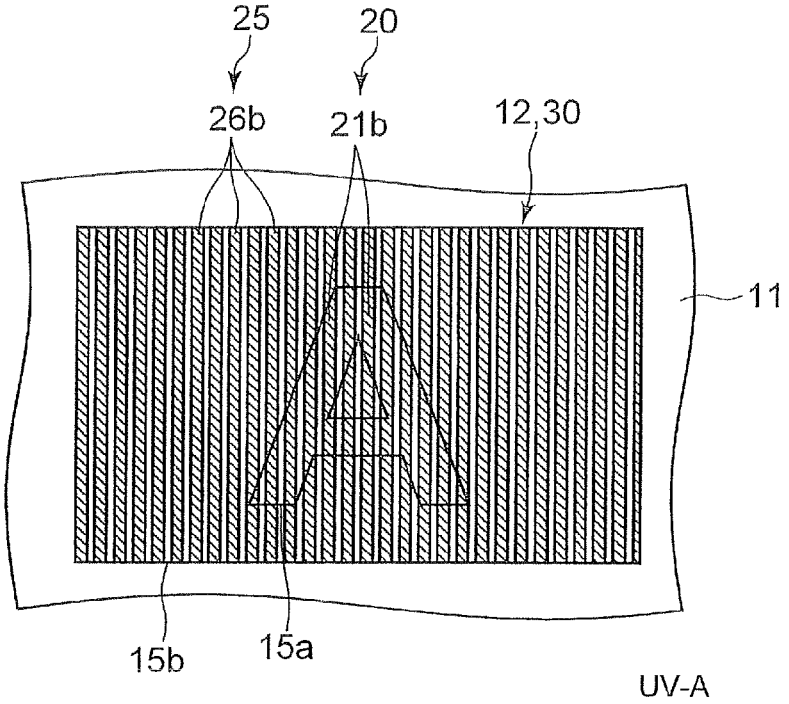
FIG. 9A is a plan view showing the light-emitting image when the UV-A is irradiated thereon, in the modification example of the first embodiment of the present invention.

FIG. 9A is a plan view showing the light-emitting image of the anti-counterfeit medium 10 when the UV-A is irradiated thereon. The pattern area 20 and the background area 25 are respectively formed of blue portions 21*b* and blue portions 26*b* that are positioned in a striped pattern. As described above, even when there is a difference in thickness and/or surface roughness between the first fluorescent ink 13 of the pattern area 20 and the second fluorescent ink 14 of the background area 25, the overcoat layer 30 obscures such a difference. Thus, the blue portion 21*b* and the blue portion 26*b* are viewed as portions of the same color. Therefore, when the UV-A is irradiated, the pattern of the pattern area 20 of the light-emitting image 12 does not appear.

In this modification example, as compared with a case in which the first fluorescent ink 13 and the second fluorescent ink 14 are sold-printed on the substrate 11, a part where the blue portion 21*b* of the pattern area 20 and the blue portion 26*b* of the background area 25 are in contact with each other is smaller. Thus, even when there exits light that is randomly reflected or inflected at the part where blue portion 21*b* and the blue portion 26*b* are in contact with each other, there is less possibility that a boundary between the blue portion 21*b* and the blue portion 26*b* can be viewed because of the existence of such light. As a result, the pattern of the pattern area 20 can be more securely prevented from being found out upon irradiation of the UV-A.

(Case of Irradiation of UV-C)

Figure 9B:
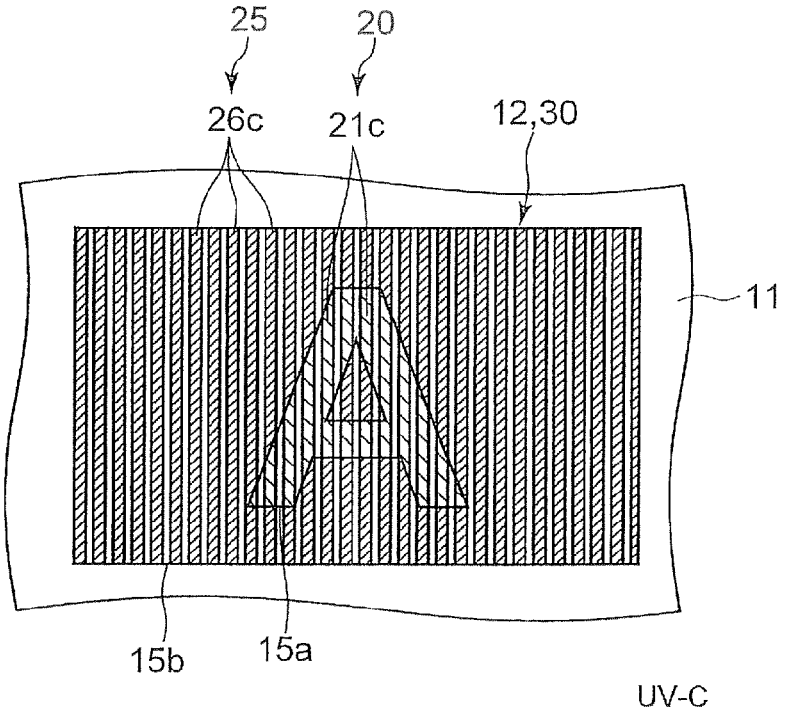
FIG. 9B is a plan view showing the light-emitting image when the UV-C is irradiated thereon, in the modification example of the first embodiment of the present invention.

FIG. 9B is a plan view showing the light-emitting image of the anti-counterfeit medium 10 when the UV-C is irradiated thereon. The pattern area 20 and the background area 25 are respectively formed of red portions 21*c* and green portions 26*c* that are positioned in a striped pattern. Thus, when the UV-C is irradiated, the pattern of the pattern area 20 of the light-emitting image 12 can be viewed.

In this modification example, there is described the example in which the first fluorescent ink 13 and the second fluorescent ink 14 are printed on the substrate 11 in a striped pattern. However, not limited thereto, the first fluorescent ink 13 and the second fluorescent ink 14 can be printed on the substrate 11 in various other patterns.

For example, the first fluorescent ink 13 and the second fluorescent ink 14 may be printed on the substrate 11 in a dotted pattern. A dot percentage at this time is not particularly limited. Any dot percentage is suitably set depending on properties required for the anti-counterfeit medium 10.

Another Modification Example

In this embodiment, there is described the example in which an ink containing the fluorescent material DE-RB is used as the first fluorescent ink 13 and an ink containing the fluorescent material DE-GB is used as the second fluorescent ink 14. Namely, there is described the example in which inks of a combination_1 shown in the below Table 1 are used. However, not limited thereto, inks of a combination_2 or inks of combination_3 in Table 1 may be used as the first fluorescent ink 13 and the second fluorescent ink 14. Similarly to the case of the combination_1, in the case of the combination_2 or the combination_3, the first fluorescent ink 13 and the second fluorescent ink 14 are inks which emit light of the same color or light of colors that are viewed as the same color when the UV-A is irradiated. Therefore, the pattern of the light-emitting image 12 can be prevented from being easily found out, whereby forging of the anti-counterfeit medium 10 can be made more difficult.

In Table 1, the colors in the "UV-A" column or in the "UV-C" column respectively means colors of light emitted from the first fluorescent ink 13 and the second fluorescent ink 14 when the UV-A or the UV-C is irradiated. The names described in the "fluorescent material" column represent product names of Nemoto & Co., Ltd. In the product name "DE-$X_1X_2$", $X_1$ means a color of light emitted upon irradiation of the UV-C, and $X_2$ means a color of light emitted upon irradiation of the UV-A. For example, the fluorescent material DE-GR is a fluorescent material which emits light of green color upon irradiation of UV-C and emits light of red color upon irradiation of UV-A.

TABLE 1

| Combination | | UV-A | UV-C | Fluorescent Material |
|---|---|---|---|---|
| 1 | First Fluorescent Ink | Blue Color | Red Color | DE-RB |
| | Second Fluorescent Ink | Blue Color | Green Color | DE-GB |
| 2 | First Fluorescent Ink | Red Color | Green Color | DE-GR |
| | Second Fluorescent Ink | Red Color | Blue Color | DE-BR |

TABLE 1-continued

| Combination | | UV-A | UV-C | Fluorescent Material |
|---|---|---|---|---|
| 3 | First Fluorescent Ink | Green Color | Blue Color | DE-BG |
| | Second Fluorescent Ink | Green Color | Red Color | DE-RG |

In this embodiment, there is described the example in which the pattern area 20 is formed by using the first fluorescent ink 13 and the background area 25 is formed by using the second fluorescent ink 14. However, not limited thereto, the pattern area 20 may be formed by using the second fluorescent ink 14 and the background area 25 may be formed by using the first fluorescent ink 13. Also in this case, the pattern of the pattern area 20 is not viewed when the UV-A is irradiated, and it is not until the UV-C is irradiated that the pattern of the pattern area 20 can be viewed. Therefore, forging of the anti-counterfeit medium 10 can be made difficult.

Second Embodiment

Next, a second embodiment of the present invention is described with reference to FIGS. 10 to 11B. The second embodiment shown in FIGS. 10 to 11B differs from the first embodiment shown in FIGS. 1 to 9B only in that the second fluorescent ink 14 is made of an ink that does not emit light when the UV-C is irradiated. The other structures are substantially the same as the aforementioned first embodiment. In the second embodiment shown in FIGS. 10 to 11B, the same parts as those of the first embodiment are shown by the same reference numbers, and description thereof is omitted.

(Second Fluorescent Ink)

The second fluorescent ink 14 in this embodiment is firstly described with reference to FIG. 10. In FIG. 10, the one-dot chain lines show a fluorescent emission spectrum of the second fluorescent ink 14 when the UV-A is irradiated, and the solid line shows a fluorescent emission spectrum of the second fluorescent ink 14 when the UV-C is irradiated. In FIG. 10, an intensity at a peak of the spectrum (solid line) upon irradiation of the UV-C is shown as a relative intensity, on the assumption that a peak intensity at a maximum peak of the spectrum (one-dot chain lines) upon irradiation of UV-A is 1.

Figure 10:
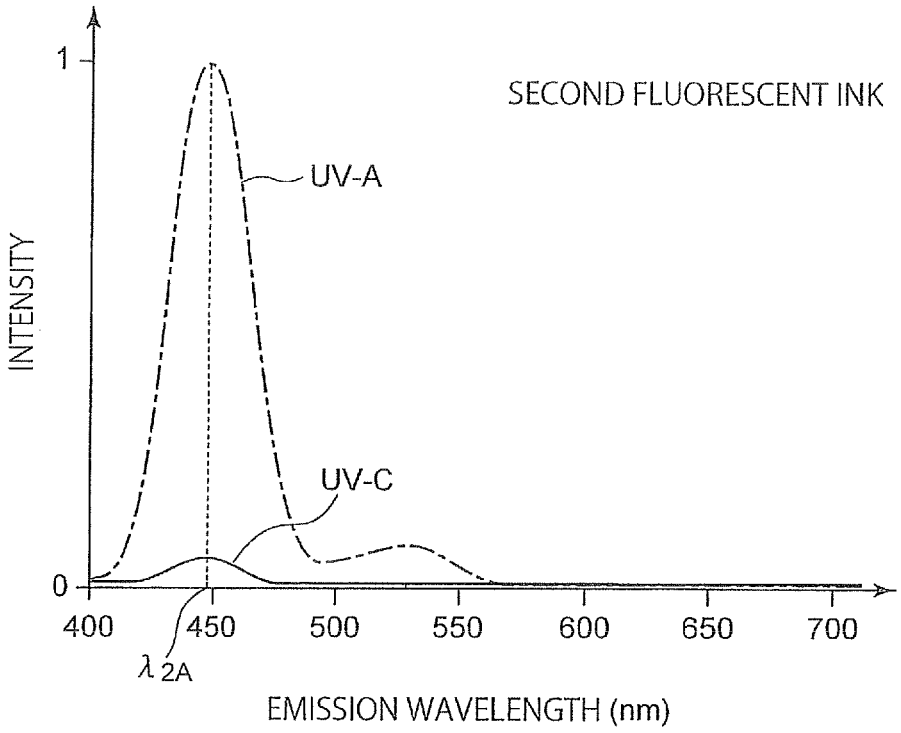
FIG. 10 is view showing a fluorescence emission spectrum of the second fluorescent ink in a second embodiment of the present invention.

As shown in FIG. 10, the second fluorescent ink 14 emits light having a peak wavelength $\lambda_{2A}$ of about 445 nm, which is light of blue color (first color) or light of a color that is viewed as the same color as the blue color (first color). When the UV-C is irradiated, the second fluorescent ink 14 emits light having a wavelength of about 445 nm whose intensity is significantly smaller than the peak intensity upon irradiation of the UV-A. Thus, because of this significantly small intensity, the light emitted from the second fluorescent ink 14 upon irradiation of the UV-C cannot be almost perceived by the naked eye. As a result, the second fluorescent ink 14 upon irradiation of the UV-C is viewed as an achromatic ink. Namely, in this embodiment, the second fluorescent material contained in the second fluorescent ink 14 is a monochromatic fluorescent ink which emits light only when the UV-A is irradiated.

In this embodiment, the term "achromatic" means that a color viewed when the second fluorescent ink 14 is observed is determined by an element that is other than a color of light emitted from the second fluorescent ink 14 itself. For example, when only the UV-C is irradiated on the second fluorescent ink 14, the second fluorescent ink 14 is viewed as an ink of black color. On the other hand, when the UV-C and the visible light are irradiated on the second fluorescent ink 14, since the visible light is scattered by the pigment particles in the second fluorescent ink 14, the second fluorescent ink 14 is viewed as an ink of white color, as described above.

In the present invention, the expression "not emit light when the UV-C is irradiated" means a concept including not only a case in which there is emitted no light when the UV-C is irradiated, but also a case in which there is emitted light whose intensity is so small that it cannot be perceived as light of a certain color by the naked eye, which is shown by the solid line in FIG. 10.

Next, an operation of this embodiment as structured above is described. Herein, a method of manufacturing the anti-counterfeit medium 10 is described at first. Then, there is described a method of examining whether a valuable paper made of the anti-counterfeit medium 10 is genuine or not.

Method of Manufacturing Anti-counterfeit Medium

At first, the substrate 11 is prepared. As the substrate 11, there is used a 188-μm thick substrate made of white polyethylene terephthalate. Then, with the use of the first fluorescent ink 13 and the second fluorescent ink 14, the light-emitting image 12 composed of the pattern area 20 and the background area 25 is formed on the substrate 11.

Since the first fluorescent ink 13 to be used herein is the same as the first fluorescent ink 13 in the first embodiment shown in FIGS. 1 to 9B, detailed description thereof is omitted. As the second fluorescent ink 14, there is used an offset lithographic ink which is obtained by adding 8 wt % of microsilica, 2 wt % of organic bentonite, 50 wt % of alkyd resin and 15 wt % of alkyl benzene-based solvent, to 25 wt % of monochromatic fluorescent material having predetermined fluorescent properties. As the monochromatic material (second fluorescent material) of the second fluorescent ink 14, there is used a fluorescent material D-1184 (manufactured by Nemoto & Co., Ltd.) which emits light of blue color when ultraviolet light having a wavelength of 365 nm is irradiated.

Then, with the use of an overcoat ink, the overcoat layer 30 having a thickness of, e.g., 2 μm is formed on the first fluorescent ink 13 of the pattern area 20 and the second fluorescent ink 14 of the background area 25. Since the overcoat ink is the same as the overcoat ink in the first embodiment, detailed description thereof is omitted.

Confirmation Method

Next, a method of examining (confirming) whether a valuable paper made of the anti-counterfeit medium 10 is genuine or not is described with reference to FIGS. 11A and 11B.

(Case of Irradiation of UV-A)

Figure 11A:
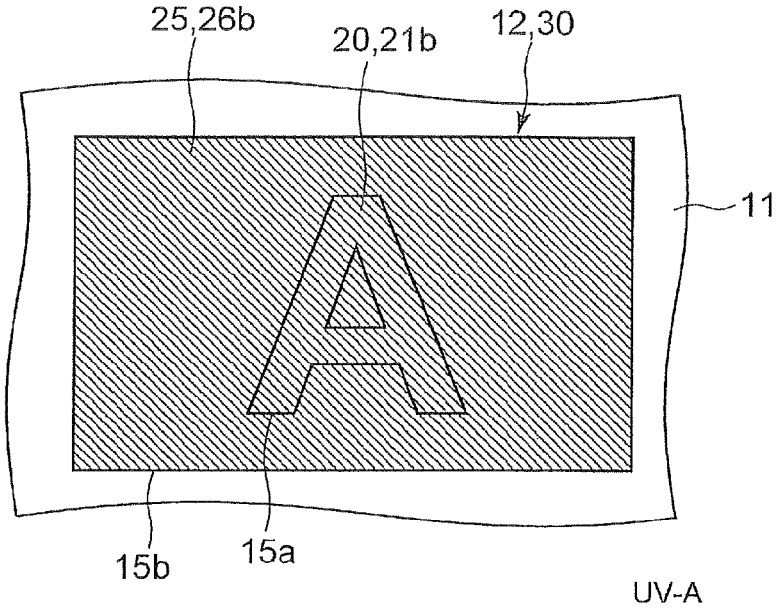
FIG. 11A is a plan view showing the light-emitting image when the UV-A is irradiated thereon, in the second embodiment of the present invention.

FIG. 11A is a plan view showing the light-emitting image of the anti-counterfeit medium 10, when the UV-A is irradiated thereon. Since the first fluorescent ink 13 forming the pattern area 20 contains the fluorescent material DE-RB, the first fluorescent ink 13 emits light of blue color. Thus, the pattern area 20 is viewed as the blue portion 21*b*. On the other hand, since the second fluorescent ink 14 forming the background area 25 contains the fluorescent material D-1184, the second fluorescent ink 14 emits light of blue color. Thus, the second background area 25 is also viewed as the blue portion 26*b*. As described above, even when there is a difference in thickness and/or surface roughness between the first fluorescent ink 13 of the pattern area 20 and the second fluorescent ink 14 of the background area 25, the overcoat layer 30 obscures such a difference. Thus, the blue portion 21*b* and the blue portion 26*b* are viewed as portions of the same color. Namely, upon irradiation of the UV-A, the pattern area 20 and the background 25 are viewed as areas of the same color. Thus, when the UV-A is irradiated, the pattern of the pattern area 20 of the light-emitting image 12 does not appear.

(Case of Irradiation of UV-C)

Figure 11B:
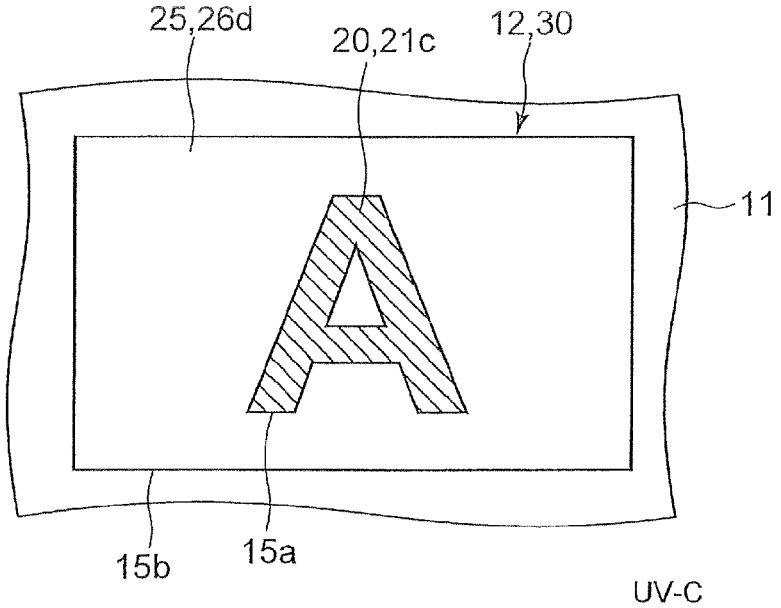
FIG. 11B is a plan view showing the light-emitting image when the UV-C is irradiated thereon, in the second embodiment of the present invention.

FIG. 11B is a plan view showing the light-emitting image 12 of the anti-counterfeit medium 10, when the UV-C is irradiated thereon. Since the first fluorescent ink 13 forming the pattern area 20 contains the fluorescent material DE-RB, the first fluorescent ink 13 emits light of red color. Thus, the pattern area 20 is viewed as the red portions 21*c*. On the other hand, since the second fluorescent ink 14 is made of the ink that does not emit light upon irradiation of the UV-C, the background area 25 is viewed as an achromatic portion 26*d*. Thus, when the UV-C is irradiated, the pattern of the pattern area 20 of the light-emitting image 12 can be viewed.

Modification Example

In this embodiment, there is described the example in which an ink containing the fluorescent material DE-RB is used as the first fluorescent ink 13, and an ink containing the fluorescent material D-1184 is used as the second fluorescent ink 14. Namely, the use of inks of a combination_1 in the below Table 2 is shown by way of example. However, not limited thereto, inks of a combination_2 to a combination_6 in Table 2 may be used as the first fluorescent ink 13 and the second fluorescent ink 14. Similarly to the combination_1, the first fluorescent ink 13 and the second fluorescent ink 14 in the combination_2 to the combination_6 are inks that emit light of the same color or light of colors that are viewed as the same color when the UV-A is irradiated. Thus, the pattern of the light-emitting image 12 can be prevented from being easily found out, whereby forging of the anti-counterfeit medium 10 can be made more difficult.

In Table 2, the term "achromatic color" in the "UV-C" column means that no light is emitted. The names described in the "fluorescent material" column represent product names of Nemoto & Co., Ltd.

TABLE 2

| Combination | | UV-A | UV-C | Fluorescent Material |
|---|---|---|---|---|
| 1 | First Fluorescent Ink | Blue Color | Red Color | DE-RB |
| | Second Fluorescent Ink | Blue Color | Achromatic Color | D-1184 |
| 2 | First Fluorescent Ink | Blue Color | Green Color | DE-GB |
| | Second Fluorescent Ink | Blue Color | Achromatic Color | D-1184 |
| 3 | First Fluorescent Ink | Red Color | Green Color | DE-GR |
| | Second Fluorescent Ink | Red Color | Achromatic Color | D-1120 |
| 4 | First Fluorescent Ink | Red Color | Blue Color | DE-BR |
| | Second Fluorescent Ink | Red Color | Achromatic Color | D-1120 |
| 5 | First Fluorescent Ink | Green Color | Blue Color | DE-BG |
| | Second Fluorescent Ink | Green Color | Achromatic Color | D-1150 |
| 6 | First Fluorescent Ink | Green Color | Red Color | DE-RG |
| | Second Fluorescent Ink | Green Color | Achromatic Color | D-1150 |

In this embodiment, there is described the example in which the pattern area 20 is formed by using the first fluorescent ink 13 and the background area 25 is formed by using the second fluorescent ink 14. However, not limited thereto, the pattern area 20 may be formed by using the second fluorescent ink 14 and the background area 25 may be formed by using the first fluorescent ink 13. Also in this case, the pattern of the pattern area 20 is not viewed when the UV-A is irradiated, and it is not until the UV-C is irradiated that the pattern of the pattern area 20 can be viewed. Therefore, forming of the anti-counterfeit medium 10 can be made difficult.

In this embodiment, similarly to the first embodiment shown in FIGS. 7 to 9B, the pattern area 20 and the background area 25 may be formed by printing, on the substrate 11, the first fluorescent ink 13 and the second fluorescent ink 14 in an identical predetermined pattern.

Third Embodiment

Next, a third embodiment of the present invention is described with reference to FIGS. 12A to 14B. The third embodiment shown in FIGS. 12A to 14B differs from the first embodiment shown in FIGS. 1 to 9B only in that the first fluorescent ink and the second fluorescent ink are selected such that the first fluorescent ink and the second fluorescent ink emit light of the same color or light of colors that are viewed as the same color when the UV-C is irradiated. The other structures are substantially the same as the aforementioned first embodiment. In the third embodiment shown in FIGS. 12A to 14B, the same parts as those of the first embodiment shown in FIGS. 1 to 9B are shown by the same reference numbers, and description thereof is omitted.

Fluorescent Inks

Figure 12A:
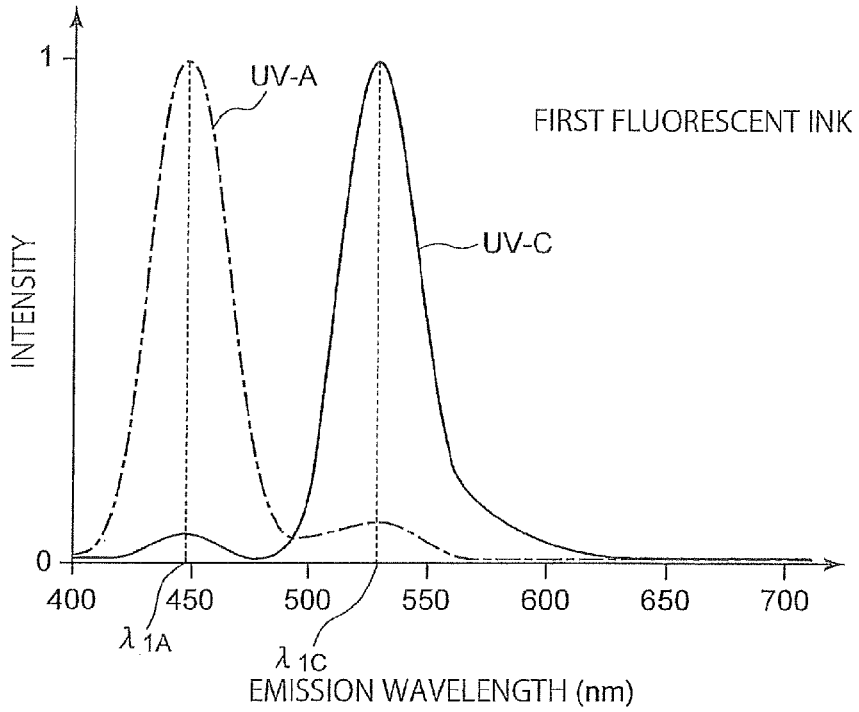
FIG. 12A is a view showing a fluorescence emission spectrum of the first fluorescent ink in a third embodiment of the present invention.
Figure 12B:
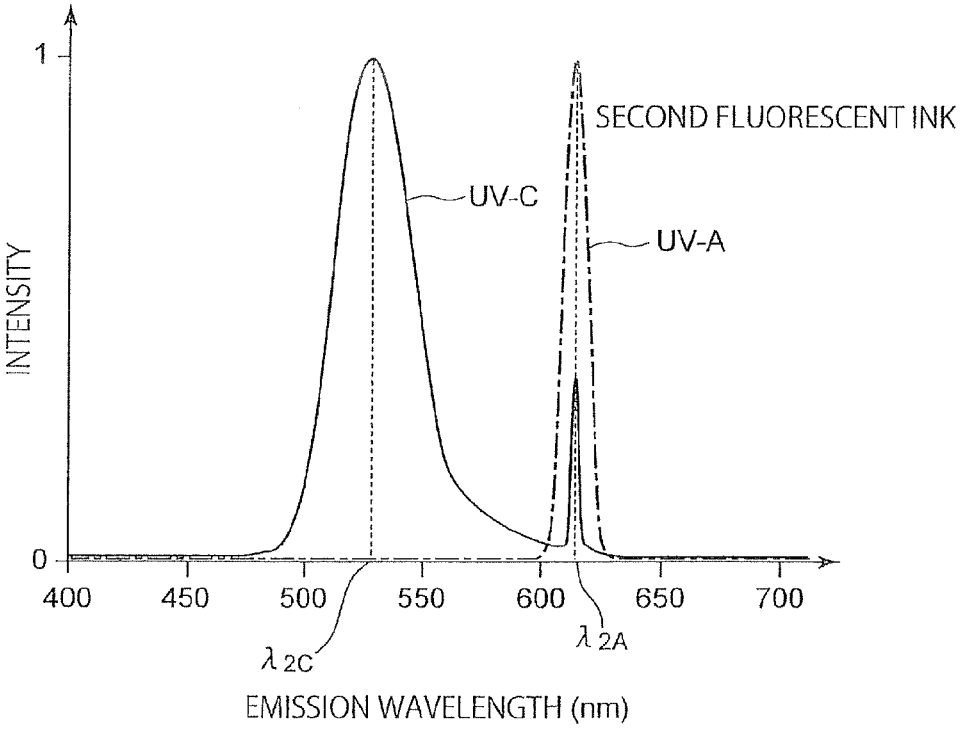
FIG. 12B is a view showing a fluorescence emission spectrum of the second fluorescent ink in the third embodiment of the present invention.
Figure 13:
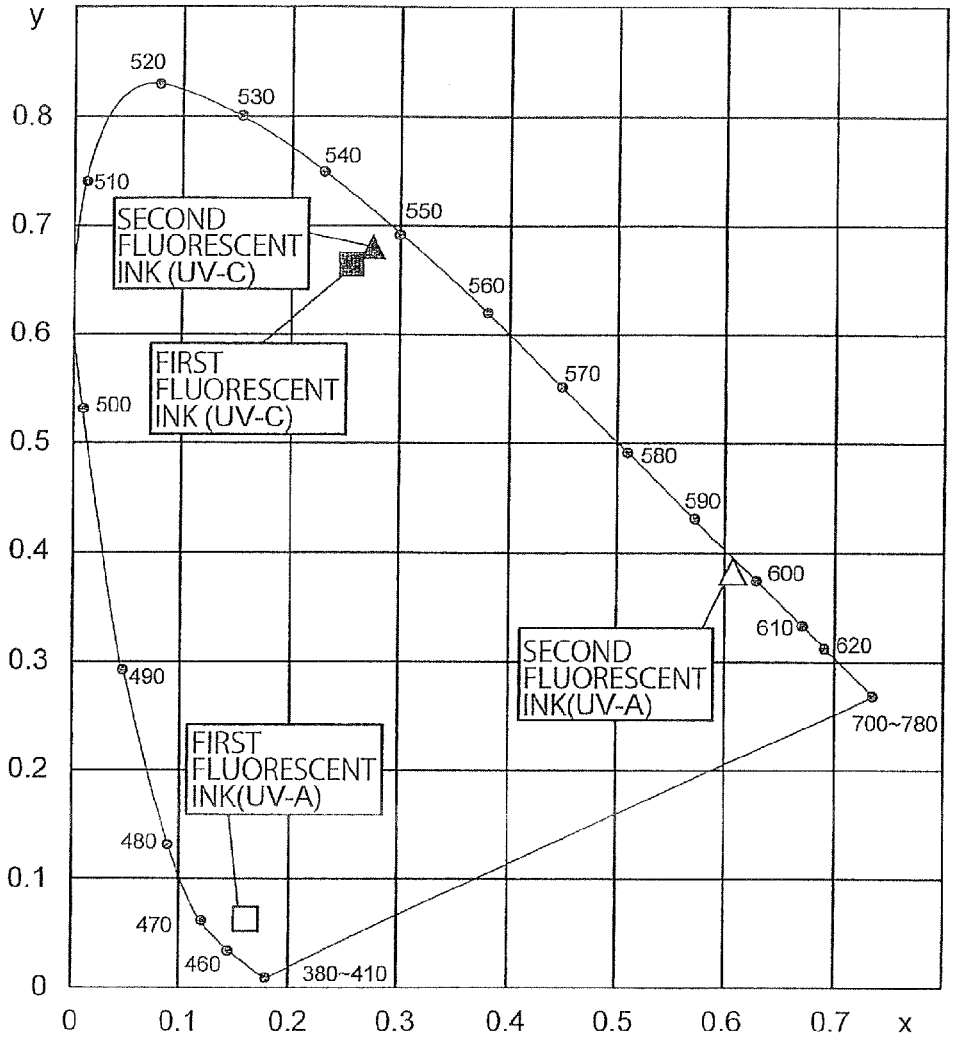
FIG. 13 is an xy chromaticity diagram showing chromaticities of fluorescent light emitted from the first fluorescent ink and chromaticities of fluorescent light emitted from the first fluorescent ink and chromaticities of fluorescent light emitted from the second fluorescent ink, in the third embodiment of the present invention.

The first fluorescent ink 13 and the second fluorescent ink 13 in this embodiment are firstly described in detail, with reference to FIGS. 12A to 13. FIG. 12A is a view showing a fluorescence emission spectrum of the first fluorescent ink 13, and FIG. 12B is a view showing a fluorescent emission spectrum of the second fluorescent ink 14. FIG. 13 is an xy chromaticity diagram showing, by means of an XYZ colorimetric system, chromaticities of fluorescent light emitted from the first fluorescent ink 13 and chromaticities of fluorescent light emitted from the second fluorescent ink 14, when light within a specific wavelength range is irradiated.

(First Fluorescent Ink)

The first fluorescent ink 13 is firstly described. In FIG. 12A, the one-dot chain lines show the fluorescence emission spectrum of the first fluorescent ink 13, when UV-A (invisible light within a second wavelength range) is irradiated. The solid line shows the fluorescence emission spectrum of the first fluorescent ink 13, when UV-C (invisible light within a first wavelength range) is irradiated. Each fluorescence emission spectrum shown in FIG. 12A is normalized such that a peak intensity at the maximum peak is 1.

As shown in FIG. 12A, when the UV-C is irradiated, the first fluorescent ink 13 emits light having a peak wavelength $\lambda_{1C}$ of about 525 nm, which is light of green color (first color). On the other hand, when the UV-A is irradiated, the first fluorescent ink 13 emits light having a peak wavelength $\lambda_{1A}$ of about 445 nm, which is light of blue color (second color).

As shown in FIG. 12A, when the UV-C is irradiated, light having a wavelength of about 445 nm is also emitted. However, the light having a wavelength of about 445 nm has an intensity that is smaller than an intensity of the light having a peak wavelength $\lambda_{1C}$ of about 525 nm. Thus, when the UV-C is irradiated, the light emitted from the first fluorescent ink 13 is viewed as light of green color. Similarly, when the UV-A is irradiated, although the light having a wavelength of about 525 nm is emitted, as shown in FIG.

12A, since an intensity thereof is small, the light emitted from the first fluorescent ink 13 is viewed as light of blue color.

(Second Fluorescent Ink)

Next, the second fluorescent ink 14 is described. In FIG. 12B, the one-dot chain lines show the fluorescent emission spectrum of the second fluorescent ink 14 when the UV-A is irradiated. The solid line shows the fluorescence emission spectrum of the second fluorescent ink 14 when the UV-C is irradiated. Similarly to the case shown in FIG. 12A, each fluorescence emission spectrum shown in FIG. 12B is normalized such that a peak intensity at the maximum peak is 1.

As shown in FIG. 12B, when the UV-C is irradiated, the second fluorescent ink 14 emits light having a peak wavelength $\lambda_{2C}$ of about 525 nm, which is light of green color (first color) or light of a color that is viewed as the same color as the green color (first color). On the other hand, when the UV-A is irradiated, the second fluorescent ink 14 emits light having a peak wavelength $\lambda_{2A}$ of about 610 nm, which is light of red color (third color).

As shown in FIG. 12B, when the UV-C is irradiated, light having a wavelength of about 610 nm is also emitted. However, the light having a wavelength of about 610 nm has an intensity that is smaller than an intensity of the light having a peak wavelength $\lambda_{2C}$ of about 525 nm. Thus, when the UV-C is irradiated, the light emitted form the second fluorescent ink 14 is viewed as light of green color.

Next, the chromaticities of light emitted from the first fluorescent ink 13 and the second fluorescent ink 14 when the UV-A or the UV-C is irradiated are described in more detail with reference to FIG. 13. As to symbols shown in FIG. 13, a blank square represents a chromaticity of light emitted from the first fluorescent ink 13 upon irradiation of the UV-A, and a blank triangle represents a chromaticity of light emitted from the second fluorescent ink 14 upon irradiation of the UV-A. A black square represents a chromaticity of light emitted from the first fluorescent ink 13 upon irradiation of the UV-C, and a black triangle represents a chromaticity of light emitted from the second fluorescent ink 14 upon irradiation of the UV-C.

The aforementioned green color (first color) corresponds to the chromaticity represented by the black square shown in FIG. 13. The aforementioned blue color (second color) corresponds to the chromaticity represented by the blank square in shown FIG. 13. The aforementioned red color (third color) corresponds to the blank triangle shown in FIG. 13.

As shown in FIG. 13, in the xy chromaticity diagram, the chromaticity of the light emitted from the first fluorescent ink 13 upon irradiation of the UV-C and the chromaticity of the light emitted from the second fluorescent ink 14 upon irradiation of the UV-C are close to each other. Thus, as described above, the light emitted from the second fluorescent ink 14 when the UV-C is irradiated is viewed as light of the same color as the color of light emitted from the first fluorescent ink 13 upon irradiation of the UV-C. Thus, the pattern area 20 formed by using the first fluorescent ink 13 and the background area 25 formed by using the second fluorescent ink 14 are viewed as areas of the same color upon irradiation of the UV-C. Therefore, as described below, upon irradiation of the UV-C, the light-emitting image 12 is viewed as image of the monochromatic color (green color), whereby the pattern of the pattern area 20 does not appear.

As shown in FIG. 13, in the xy chromaticity diagram, the chromaticity of the light emitted from the first fluorescent ink 13 upon irradiation of the UV-A and the chromaticity of the light emitted from the second fluorescent ink 14 upon irradiation of the UV-C are greatly distant from each other. Thus, the light emitted from the second fluorescent ink 14 when the UV-A is irradiated is viewed as light of a color that is different from the color of light emitted from the first fluorescent ink 13 upon irradiation of the UV-A. Thus, upon irradiation of UV-A, the pattern area 20 formed by using the first fluorescent ink 13 and the background area 25 formed by using the second fluorescent ink 14 are viewed as areas of different colors. Therefore, as described below, upon irradiation of the UV-A, the pattern of the pattern area 20 can be viewed.

Next, an operation of this embodiment as structured above is described. Herein, a method of manufacturing the anti-counterfeit medium 10 is firstly described. Then, there is described a method of examining whether a valuable paper made of the anti-counterfeit medium 10 is genuine or not.

Method of Manufacturing Anti-counterfeit Medium

At first, the substrate 11 is prepared. As the substrate 11, there is used a 188-μm thick substrate made of white polyethylene terephthalate. Then, by using the first fluorescent ink 13 and the second fluorescent ink 14, the light-emitting image 12 composed of the pattern area 20 and the background area 25 is formed on the substrate 11.

At this time, as the first fluorescent ink 13 and the second fluorescent ink 14, there are used offset lithographic inks each of which is obtained by, for example, adding 8 wt % of microsilica, 2 wt % of organic bentonite, 50 wt % of alkyd resin and 15 wt % of alkyl benzene-based solvent, to 25 wt % of dichromatic fluorescent material having predetermined fluorescent properties. As the dichromatic material (first fluorescent material) for the first fluorescent ink 13, there is used a fluorescent material DE-GB (manufactured by Nemoto & Co., Ltd.) which emits light of green color when being excited by ultraviolet light having a wavelength of 254 nm, and emits light of blue color when being excited by ultraviolet light having a wavelength of 365 nm. As the dichromatic material (second fluorescent material) for the second fluorescent ink 14, there is used a fluorescent material DE-GR (manufactured by Nemoto & Co., Ltd.) which emits light of green color when being excited by ultraviolet light having a wavelength of 254 nm, and emits light of red color when being excited by ultraviolet light having a wavelength of 365 nm. The dichromatic fluorescent materials of the first and second fluorescent inks 13 and 14 are respectively selected such that, when ultraviolet light having a wavelength of 254 nm is irradiated, a color difference $\Delta E^*_{ab}$ between the light of green color emitted from the first fluorescent ink 13 and the light of green color emitted from the second fluorescent ink 14 is not more than 10, preferably not more than 3.

Then, with the use of an overcoat ink, the overcoat layer 30 having a thickness of, e.g., 2 μm is formed on the first fluorescent ink 13 of the pattern area 20 and the second fluorescent ink 14 of the background area 25. Since the overcoat ink is the same as the overcoat ink in the first embodiment, detailed description thereof is omitted.

Confirmation Method

Next, a method of examining (confirming) whether a valuable paper made of the anti-counterfeit medium 10 is genuine or not is described with reference to FIGS. 14A and 14B.

(Case of Irradiation of UV-C)

Figure 14A:
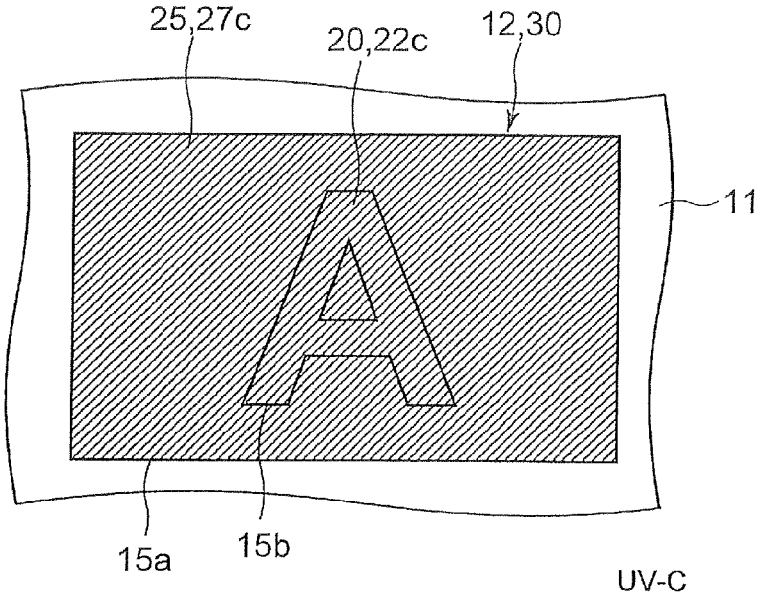
FIG. 14A is a plan view showing the light-emitting image when the UV-C is irradiated thereon, in the third embodiment of the present invention.

FIG. 14A is a plan view showing the light-emitting image of the anti-counterfeit medium 10 when the UV-C is irradiated thereon. Since the first fluorescent ink 13 forming the pattern area 20 contains the fluorescent material DE-GB, the first fluorescent ink 13 emits light of green color. Thus, the pattern area 20 is viewed as a green portion 22*c*. On the other hand, since the second fluorescent ink 14 forming the background area 25 contains the fluorescent material DE-GR, the second fluorescent ink 14 emits light of green color. Thus, the background area 25 is also viewed as a green portion 27*c*. As described above, even when there is a difference in thickness and/or surface roughness between the first fluorescent ink 13 of the pattern area 20 and the second fluorescent ink 14 of the background area 25, the overcoat layer 30 obscures such a difference. Thus, the green portion 22*c* and the green portion 27*c* are viewed as portions of the same color. Namely, upon irradiation of the UV-C, the pattern area 20 and the background 25 are viewed as areas of the same color. As a result, when the UV-C is irradiated, the pattern of the pattern area 20 of the light-emitting image 12 does not appear.

(Case of Irradiation of UV-A)

Figure 14B:
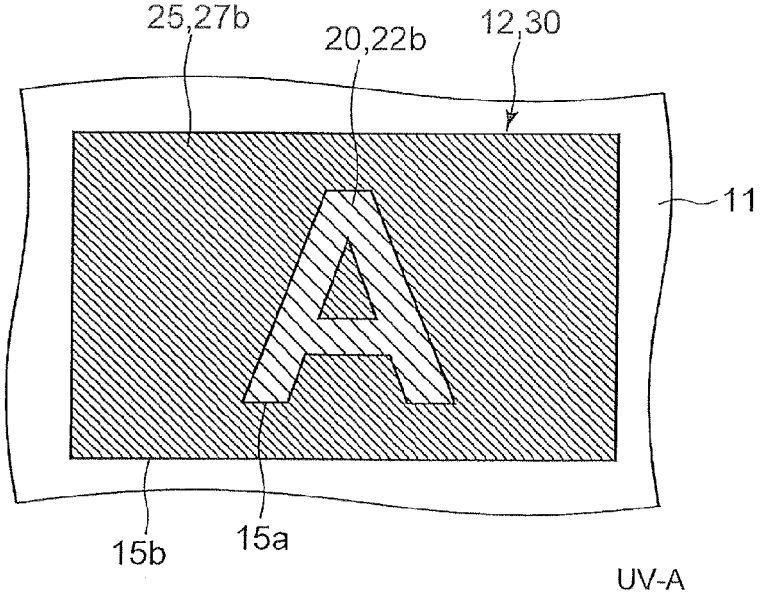
FIG. 14B is a plan view showing the light-emitting image when the UV-A is irradiated thereon, in the third embodiment of the present invention.

FIG. 14B is a plan view showing the light-emitting image of the anti-counterfeit medium 10 when the UV-A is irradiated thereon. Since the first fluorescent ink 13 forming the pattern area 20 contains the fluorescent material DE-GB, the first fluorescent ink 13 emits light of blue color. Thus, the pattern area 20 is viewed as a blue portion 22*b*. On the other hand, since the second fluorescent ink 14 forming the background area 25 contains the fluorescent material DE-GR, the second fluorescent ink 14 emits light of red color. Thus, the background area 25 is viewed as a red portion 27*b*. Namely, upon irradiation of UV-A, the pattern area 20 and the background area 25 are viewed as areas of different colors. As a result, when the UV-A is irradiated, the pattern of the pattern area 20 of the light-emitting image 12 can be viewed.

According to the first to third embodiments, the anti-counterfeit medium 10 includes the substrate 11, the pattern area 20 formed on the substrate 11 by using the first fluorescent ink 13 containing the first fluorescent material, the background area 25 formed on the substrate 11 by using the second fluorescent ink 14 containing the second fluorescent material such that the background area 25 is adjacent to the pattern area 20, and the overcoat layer 30 formed on the first fluorescent material of the pattern area 20 and the second fluorescent material of the background area 25. The overcoat layer 30 transmits therethrough the UV-A and the UV-C. In the first and second embodiments, the first fluorescent material of the first fluorescent ink 13 is made of the fluorescent material DE-RB which emits light of blue color (first color) when the UV-A is irradiated, and emits light of red color (second color) when UV-C is irradiated. On the other hand, in the first embodiment, the second fluorescent material of the second fluorescent ink 14 is made of the fluorescent material DE-GB which emits light of blue color (first color) or light of a color that is viewed as the same color as the blue color (first color) when the UV-A is irradiated, and emits light of green color (third color) when the UV-C is irradiated. Meanwhile, in the second embodiment, the second fluorescent material of the second fluorescent ink 14 is made of the fluorescent material D-1184 which emits light of blue color (first color) or light of a color that is viewed as the same color as the blue color (first color) when the UV-A is irradiated, and does not emit light when the UV-C is irradiated. In the third embodiment, the first fluorescent material of the first fluorescent ink 13 is made of the fluorescent material DE-GB which emits light of green color (first color) when the UV-C is irradiated, and emits light of blue color (second color) when the UV-A is irradiated. On the other hand, the second fluorescent material of the second fluorescent ink 14 is made of the fluorescent material DE-GR which emits light of green color (first color) or light of a color that is viewed as the same color as the green color (first color) when the UV-C is irradiated, and emits light of red color (third color) when the UV-A is irradiated. Thus, according to the first and second embodiments, the pattern area 20 and the background area 25 are not discriminated when the UV-A is irradiated, and it is not until the UV-C is irradiated that the pattern area 20 and the background area 25 can be discriminated. Namely, the pattern of the pattern area 20 is not viewed when the UV-A is irradiated, and it is not until the UV-C is irradiated that the pattern of the pattern area 20 can be viewed. In addition, according to the third embodiment, the pattern area 20 and the background area 25 are not discriminated when the UV-C is irradiated, and it is not until the UV-A is irradiated that the pattern area 20 and the background area 25 can be discriminated. Namely, the pattern of the pattern area 20 is not viewed when the UV-C is irradiated, and it is not until the UV-A is irradiated that the pattern of the pattern area 20 can be viewed.

In this manner, by forming the pattern area 20 and the background area 25 with the use of inks containing the dichromatic fluorescent materials, forging of the anti-counterfeit medium 10 can be made difficult as compared with a case in which an ink containing a monochromatic fluorescent material is used. In addition, whether the light-emitting image 12 is genuine or not can be easily and promptly judged by the naked eye.

In addition, by selecting the first fluorescent material of the first fluorescent ink 13 and the second fluorescent material of the second fluorescent ink 14 such that the first fluorescent ink 13 and the second fluorescent ink 14 emit light of the same color or light of colors that are viewed as the same color, when the UV-A is irradiated (first and second embodiments) or when the UV-C is irradiated (third embodiment), the pattern of the light-emitting image 12 can be prevented from being easily found out. Therefore, forging of the anti-counterfeit medium 10 can be made more difficult.

Further, even when there is a difference in thickness and/or surface roughness between the pattern area 20 of the light-emitting image 12 and the background area 25 thereof, the overcoat layer 30 obscures such a difference. Thus, when the UV-A (first and second embodiments) or the UV-C (third embodiment) is irradiated, the pattern area 20 and the background area 25 are viewed as areas of the same color. Therefore, the pattern of the light-emitting image 12 can be more securely prevented from being easily found out. As a result, forging of the anti-counterfeit medium 10 can be made furthermore difficult.

Modification Example

In this embodiment, there is described the example in which an ink containing the fluorescent material DE-GB is used as the first fluorescent ink 13, and an ink containing the fluorescent material DE-GR is used as the second fluorescent ink 14. Namely, the use of inks of a combination_1 in the below Table 3 is shown by way of example. However, not limited thereto, inks of a combination_2 or a combination_3 in Table 3 may be used as the first fluorescent ink 13 and the second fluorescent ink 14. Similarly to the combination_1, the first fluorescent ink 13 and the second fluorescent ink 14 in the combination_2 or the combination_3 are inks that emit light of the same color or light of colors that are viewed as the same color when, the UV-A is irradiated. Thus, the pattern of the light-emitting image 12 can be prevented from being easily found out, whereby forging of the anti-counterfeit medium 10 can be made more difficult.

In Table 3, the names described in the "fluorescent material" column represent product names of Nemoto & Co., Ltd.

TABLE 3

| Combination | | UV-A | UV-C | Fluorescent Material |
|---|---|---|---|---|
| 1 | First Fluorescent Ink | Blue Color | Green Color | DE-GB |
| | Second Fluorescent Ink | Red Color | Green Color | DE-GR |
| 2 | First Fluorescent Ink | Green Color | Red Color | DE-RG |
| | Second Fluorescent Ink | Blue Color | Red Color | DE-RB |
| 3 | First Fluorescent Ink | Red Color | Blue Color | DE-BR |
| | Second Fluorescent Ink | Green Color | Blue Color | DE-BG |

Another Embodiment

In this embodiment, there is described the example in which the second fluorescent ink 14 is made of a dichromatic fluorescent material. However, not limited thereto, similarly to the second embodiment shown in FIGS. 10 to 11B, the second fluorescent ink 14 may be made of a monochromatic fluorescent material. The combination of the first fluorescent ink 13 and the second fluorescent ink 14 is not particularly limited, and various combinations may be suitably selected as shown in the below Table 4.

In Table 4, the names described in the "fluorescent material" column represent product names of Nemoto & Co., Ltd.

TABLE 4

| Combination | | UV-A | UV-C | Fluorescent Material |
|---|---|---|---|---|
| 1 | First Fluorescent Ink | Blue color | Green Color | DE-GB |
| | Second Fluorescent Ink | Achromatic Color | Green Color | GG-49 |
| 2 | First Fluorescent Ink | Red Color | Green Color | DE-GR |
| | Second Fluorescent Ink | Achromatic Color | Green Color | GG-49 |
| 3 | First Fluorescent Ink | Green Color | Red Color | DE-RG |
| | Second Fluorescent Ink | Achromatic Color | Red Color | DE-RN |
| 4 | First Fluorescent Ink | Blue Color | Red Color | DE-RB |
| | Second Fluorescent Ink | Achromatic Color | Red Color | DE-RN |
| 5 | First Fluorescent Ink | Red Color | Blue color | DE-BR |
| | Second Fluorescent Ink | Achromatic Color | Blue color | DE-BN |
| 6 | First Fluorescent Ink | Green Color | Blue color | DE-BG |
| | Second Fluorescent Ink | Achromatic Color | Blue color | DE-BN |

In this embodiment, there is described the example in which the pattern area 20 is formed by using the first fluorescent ink 13 and the background area 25 is formed by using the second fluorescent ink 14. However, not limited thereto, the pattern area 20 may be formed by using the second fluorescent ink 14 and the background area 25 may be formed by using the first fluorescent ink 13. Also in this case, the pattern of the pattern area 20 is not viewed when the UV-C is irradiated, and it is not until the UV-A is irradiated that the pattern of the pattern area 20 can be viewed. Therefore, forming of the anti-counterfeit medium 10 can be made difficult.

In this embodiment, similarly to the first embodiment shown in FIGS. 7 to 9B, the pattern area 20 and the background area 25 may be formed by printing, on the substrate 11, the first fluorescent ink 13 and the second fluorescent ink 14 in an identical predetermined pattern.

Next, as fourth to sixth embodiments, there is described an example in which the light-emitting image is formed by micro-characters.

Fourth Embodiment

A fourth embodiment of the present invention is described herebelow with reference to FIGS. 15 to 17B. The fourth embodiment shown in FIGS. 15 to 1713 differs from the first embodiment shown in FIGS. 1 to 9B only in that the light-emitting image is composed of micro-characters. The other structures are substantially the same as the aforementioned first embodiment. In the fourth embodiment shown in FIGS. 15 to 1713, the same parts as those of the first embodiment shown in FIGS. 1 to 9B are shown by the same reference numbers, and detailed description thereof is omitted.

Light-Emitting Image

Figure 15:
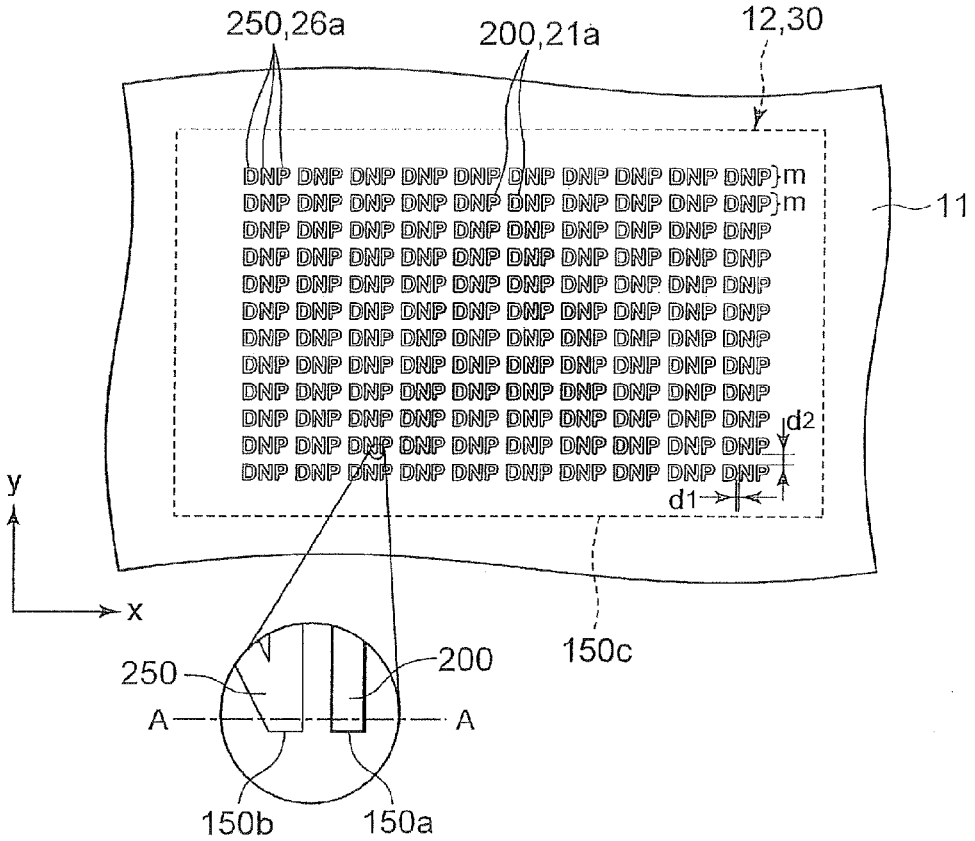
FIG. 15 is a plan view showing the light-emitting image of the anti-counterfeit medium in a fourth embodiment of the present invention.
Figure 16:
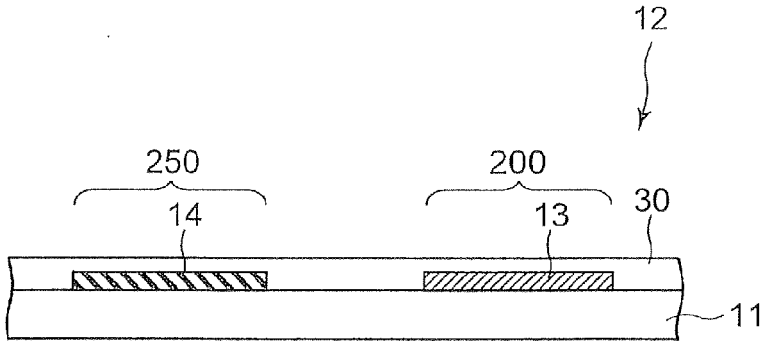
FIG. 16 is a sectional view taken along a line A-A of the light-emitting image shown in FIG. 15.

Next, the light-emitting image 12 is described in more detail with reference to FIGS. 15 and 16. FIG. 15 is a plan view showing the light-emitting image 12 in enlargement under visible light. FIG. 16 is a sectional view taken along a line A-A of the light-emitting image 12 shown in FIG. 15.

The light-emitting image 12 includes a plurality of first pattern elements 200 and a plurality of second pattern elements 250. In the example shown in FIG. 15, each of the first pattern elements 200 and each of the second pattern elements 250 constitute micro-characters of "D", "N" and "P". Ten sets of the series of micro-characters "DNP" are arranged in an x direction to form micro-character rows m. Twelve micro-character rows m are arranged in a y direction. The first pattern elements 20 form a latent image in the micro-character rows. Herein, the latent image is a character "A".

A size of one micro-character in the plurality of micro-character rows m is preferably not more than 300 μm square, and is herein 200 μm square, for example. An interval d1 between the micro-characters that are adjacent in the x direction of the micro-character rows m, and an interval d2 between the micro-characters that are adjacent in the y direction are preferably not more than 100 μm, respectively. Herein, the interval d1 is 50 μm and the interval d2 is 100 μm, for example.

Although the resolution of a human naked eye differs by an acuity of vision and a distance from the eye to an object, a recognizable resolution limit of a person whose acuity of vision is 1.5 at a distance of distinct vision of 250 mm is, for example, 250*tan(1/1.5/60)*2=0.1 (mm).

The resolution limit herein means a distance at which two adjacent points can be recognized as two points.

When the size of the character is not more than 300 μm square, an interval between lines constituting the character is often about 100 μm. Such a character cannot be generally recognized as a character by the naked eye.

When the interval between characters is not more than 100 μm, adjacent characters cannot be recognized as different characters.

As show in FIG. 16, the first pattern element 200 of the light-emitting image 12 and the second pattern elements 250 thereof are formed by printing the first fluorescent ink 13 and the second fluorescent ink 14 on the substrate 11.

The overcoat layer 30 is formed by, e.g., screen-printing an overcoat ink on the substrate 11, the first pattern elements 200 and the second pattern elements 250. The overcoat layer 30 has a substantially flat surface.

Thicknesses of the first fluorescent ink 13, the second fluorescent ink 14 and the overcoat layer 30 are similar to those of the first embodiment. In the fourth to sixth embodiments, the thickness of the overcoat layer 30 means a thickness of a portion above the first pattern element 200 or the second pattern element 250.

As described above, the first fluorescent ink 13 and the second fluorescent ink 14 are the same as the first fluorescent ink 13 and the second fluorescent ink 14 described in the first embodiment. The overcoat layer 30 is substantially achromatic and transparent.

Therefore, as show in FIG. 15, when the light-emitting image 12 is seen under visible light, white first pattern elements 21*a* are viewed as the first pattern elements 200, and white second pattern elements 26*a* are viewed as the second pattern elements 250. As described above, the substrate 11 is made of white polyethylene terephthalate. For this reason, under the visible light, the substrate 11, the first pattern element 200 of the light-emitting image 12 and the second pattern element 250 thereof are all viewed as areas of white color. Thus, the latent image (pattern) of the first pattern elements 200 of the light-emitting image 12 does not appear under the visible light.

Accordingly, the anti-counterfeit medium 10 including the light-emitting image 12 can be prevented from being easily forged.

In FIG. 15, a line 150*a* showing each first pattern element 200, a line 150*b* showing each second pattern element 250, and line 150*c* showing the light-emitting image 12 are drawn as a matter of convenience. Under the visible light, the line 150*a*, the line 150*b* and the line 150*c* cannot be actually viewed.

Next, an operation of this embodiment as structured above is described. Herein, a method of manufacturing the anti-counterfeit medium 10 is firstly described. Then, there is described a method of examining whether a valuable paper made of the anti-counterfeit medium 10 is genuine or not.

Method of Manufacturing Anti-counterfeit Medium

At first, the substrate 11 is prepared. As the substrate 11, there is used a 188-μm thick substrate made of white polyethylene terephthalate. Then, by using the first fluorescent ink 13 and the second fluorescent ink 14, the light-emitting image 12 composed of the first pattern elements 200 and the second pattern elements 250 is formed on the substrate 11.

At this time, as described above, the first fluorescent ink 13 and the second fluorescent ink 14 in the first embodiment are used as the first fluorescent ink 13 and the second fluorescent ink 14.

Then, with the use of an overcoat ink, the overcoat layer having a thickness of, e.g., 2 μm is formed by screen-printing the overcoat ink on the substrate 11, the first pattern elements 200 and the second pattern elements 250. At this time, the overcoat ink in the first embodiment is used as the overcoat ink.

Confirmation Method

Next, a method of examining (confirming) whether a valuable paper made of the anti-counterfeit medium 10 is genuine or not is described with reference to FIGS. 15, 17A and 17B.

(Case of Irradiating Visible Light)

At first, the anti-counterfeit medium 10 is observed under visible light. In this case, as described above, the substrate 11, the first pattern elements 200 of the light-emitting image 12 and the second pattern elements 250 thereof are respectively viewed as areas of white color (see FIG. 15). Thus, under the visible light, the latent image of the first pattern elements 200 of the light-emitting image 12 does not appear.

(Case of Irradiation of UV-A)

Then, the anti-counterfeit medium 10 when the UV-A is irradiated thereon is observed. As the UV-A to be irradiated, ultraviolet light having a wavelength of 365 nm is used, for example. The UV-A transmits through the overcoat layer 30 to reach the first fluorescent ink 13 forming the first pattern elements 200 and the second fluorescent ink 14 forming the second pattern elements 250.

Figure 17A:
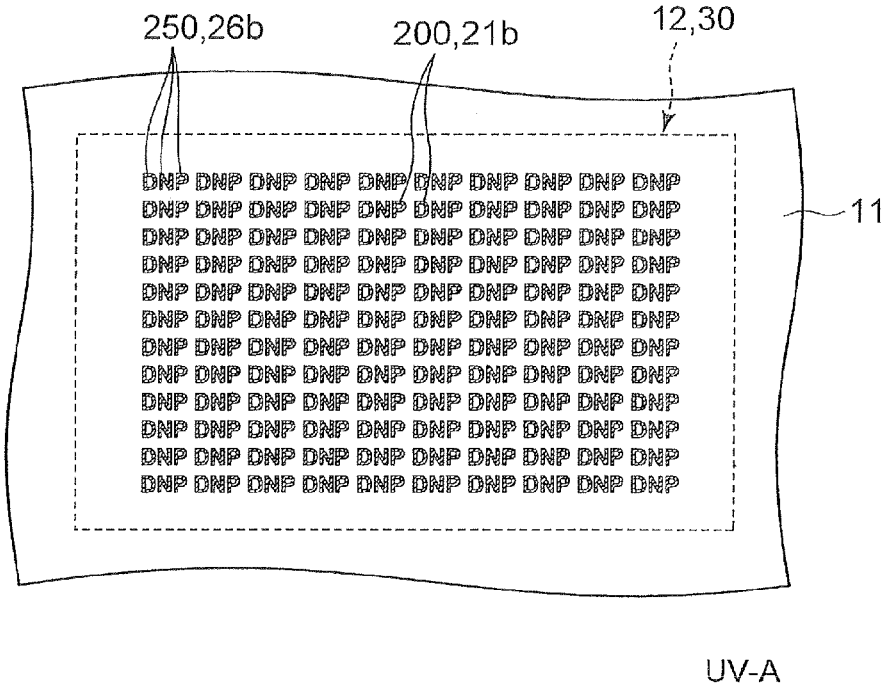
FIG. 17A is a plan view showing the light-emitting image when the UV-A is irradiated thereon, in the fourth embodiment of the present invention.

FIG. 17A is a plan view showing the light-emitting image 12 of the anti-counterfeit medium 10, when the UV-A is irradiated thereon. Since the first fluorescent ink 13 forming the first pattern elements 200 contains the fluorescent material DE-RB, the first fluorescent ink 13 emits light of blue color. Thus, the first pattern elements 200 are viewed as blue portions 21*b*. On the other hand, since the second fluorescent ink 14 forming the second pattern elements 250 contains the fluorescent material DE-GB, the second fluorescent ink 14 emits light of blue color. Thus, the second pattern elements 250 are also viewed as blue portions 26*b*. Even when there is a difference in thickness and/or surface roughness between the first fluorescent ink 13 of the first pattern elements 200 and the second fluorescent ink 14 of the second pattern elements 250, the overcoat layer 30 obscures such a difference. Thus, the blue portions 21*b* and the blue portion 26*b* are viewed as portions of the same color. Namely, when the UV-A is irradiated, the first pattern elements 200 and the second pattern elements 250 are viewed as micro-characters of the same color. Thus, when the UV-A is irradiated, the latent image of the first pattern elements 200 of the light-emitting image 12 is buried in the micro-character rows m, and does not appear.

(Case of Irradiation of UV-C)

Then, the anti-counterfeit medium 10 when the UV-C is irradiated thereon is observed. As the UV-C to be irradiated, ultraviolet light having a wavelength of 254 nm is used, for example. The UV-C transmits through the overcoat layer 30 to reach the first fluorescent ink 13 forming the first pattern elements 200 and the second fluorescent ink 14 forming the second pattern elements 250.

Figure 17B:
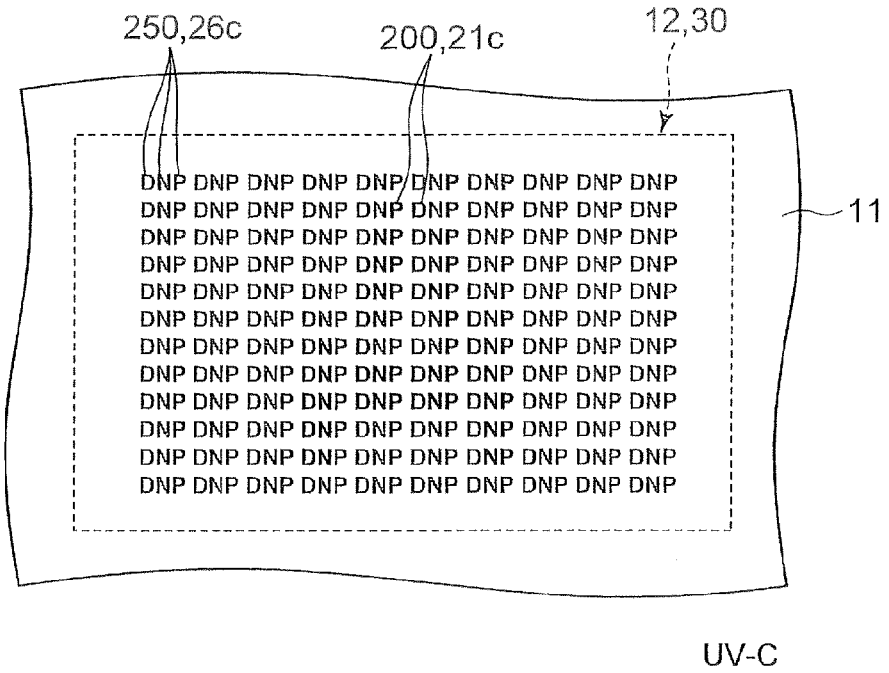
FIG. 17B is a plan view showing the light-emitting image when the UV-C is irradiated thereon, in the fourth embodiment of the present invention.

FIG. 17B is a plan view showing the light-emitting image 12 of the anti-counterfeit medium 10, when the UV-C is irradiated thereon. Since the first fluorescent ink 13 forming the first pattern elements 200 contains the fluorescent material DE-RB, the first fluorescent ink 13 emits light of red color. Thus, the first pattern elements 200 are viewed as red portions 21*c*. On the other hand, since the second fluorescent ink 14 forming the second pattern elements 250 contains the fluorescent material DE-GB, the second fluorescent ink 14 emits light of green color. Thus, the second pattern elements 250 are viewed as green portions 26*c*. Namely, when the UV-C is irradiated, the first pattern elements 200 and the second pattern elements 250 are viewed as micro-characters of different colors. Thus, when the UV-C is irradiated, the latent image in the micro-character rows m, which is composed of the first pattern elements 200 of the light-emitting image 12, appears and thus can be viewed. As described above, the latent image of the character "A" is viewed herein.

When the visible light, the UV-A and UV-C are irradiated, by examining whether the colors of the first pattern elements 200 and the second pattern elements 250 change in the manner as described above, whether the valuable paper made of the anti-counterfeit medium 10 is genuine or not can be confirmed.

Modification Example

In this embodiment, the one micro-character is formed by the one first pattern element 200 or the one second pattern element 250. However, not limited thereto, the one micro-character may include both the first pattern element 200 and the second pattern element 250. Herebelow, there is described an example in which one micro-character includes the first pattern element 200 and the second pattern element 250, with reference to FIGS. 18A to 19B.

Figure 18A:
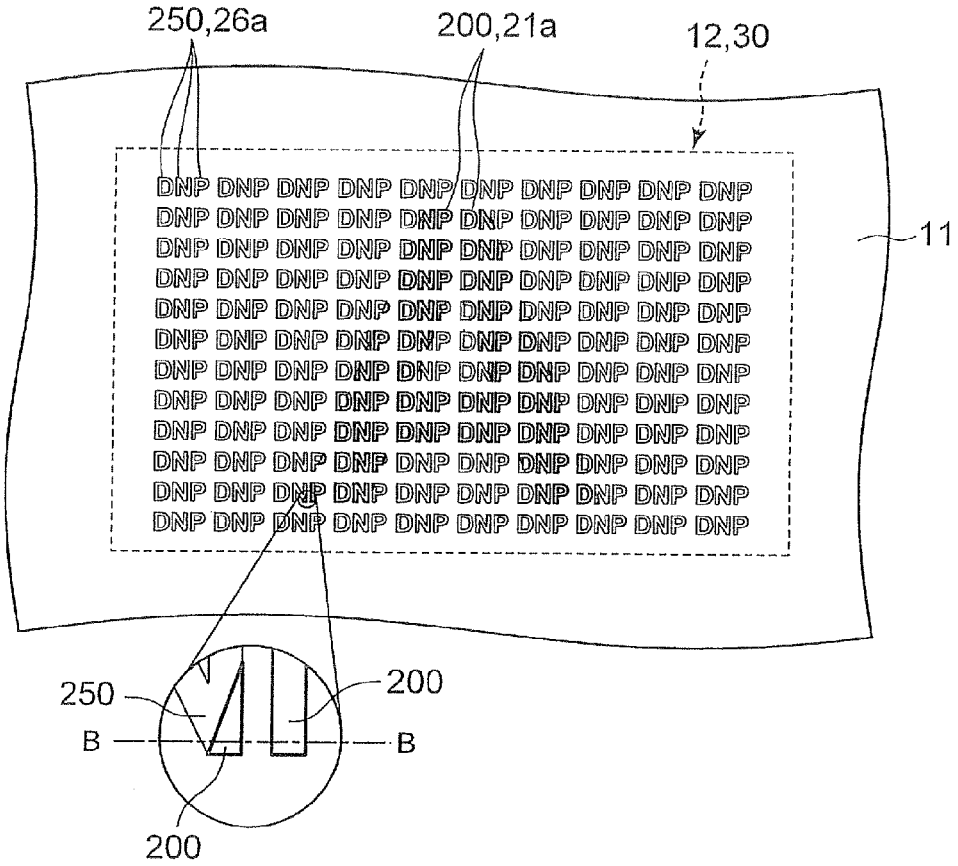
FIG. 18A is a plan view showing the light-emitting image of the anti-counterfeit medium in a modification example of the fourth embodiment of the present invention.
Figure 18B:
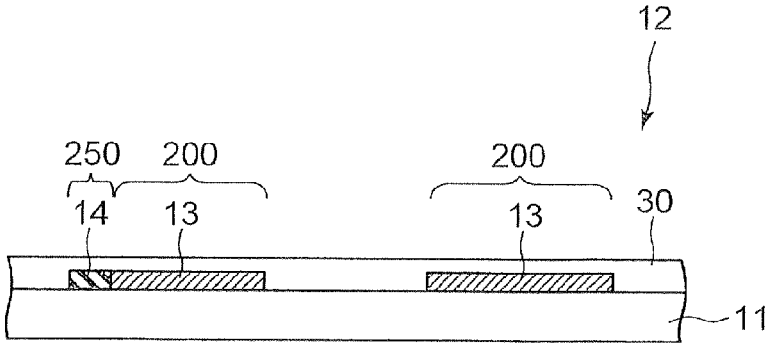
FIG. 18B is a sectional view taken along a line B-B of the light-emitting image shown in FIG. 18A.

FIG. 18A is a plan view showing the light-emitting image 12 of the anti-counterfeit medium 10 under visible light, in this modification example. FIG. 18B is a sectional view taken along a line B-B of the light-emitting image 12 shown in FIG. 18A. As shown in FIGS. 18A and 18B, in this modification example, the plurality of micro-characters have some micro-characters each of which is composed of the first pattern element 200 and the second pattern element 250. The overcoat layer 30 is formed by an overcoat ink on the substrate 11, the first pattern elements 200 and the second pattern elements 250.

Next, a method of examining whether a valuable paper made of the anti-counterfeit medium 10 is genuine or not in this modification example is described with reference to FIGS. 18A, 19A and 19B.

(Case of Irradiation of Visible Light)

Under visible light, as shown in FIG. 18A, the first pattern elements 200 and the second pattern elements 250 are formed of the white portions 21*a* and 26*a*. Thus, under the visible light, the latent image of the first pattern elements 200 of the light-emitting image 12 does not appear.

(Case of Irradiation of UV-A)

Figure 19A:
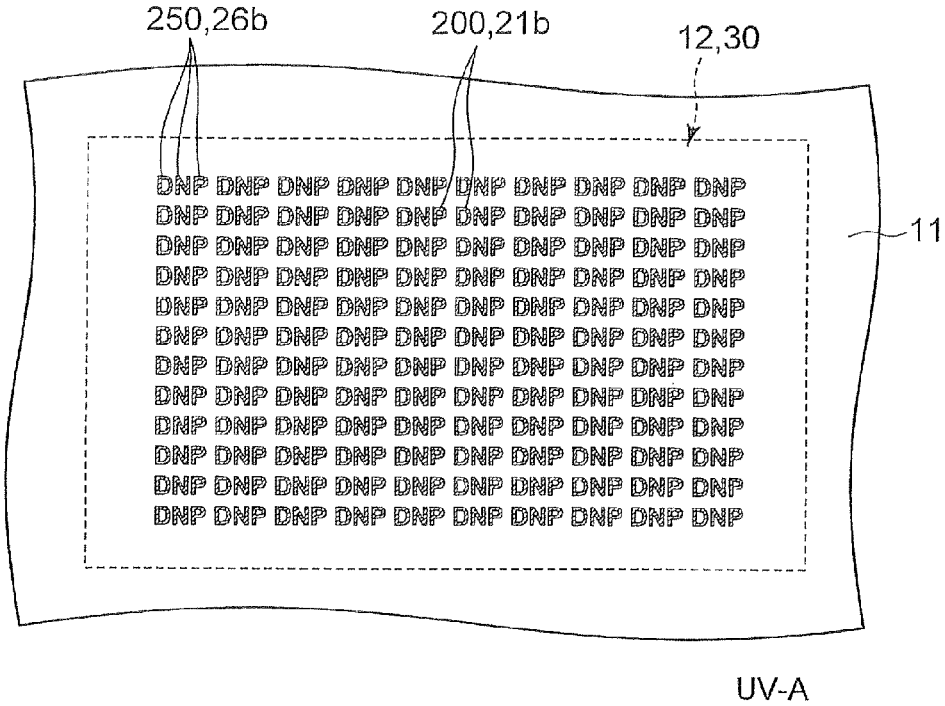
FIG. 19A is a plan view showing the light-emitting image when the UV-A is irradiated thereon, in the modification example of the fourth embodiment of the present invention.

FIG. 19A is a plan view showing the light-emitting image 12 of the anti-counterfeit medium 10 when the UV-A is irradiated thereon. The first pattern elements 200 and the second pattern elements 250 are formed of the blue portions 21*b* and 26*b*, respectively. Even when there is a difference in thickness and/or surface roughness between the first pattern element 200 and the second pattern element 250, the overcoat layer 30 obscures such a difference. Thus, the blue portions 21*b* and the blue portions 26*b* are viewed as portions of the same color. Therefore, when the UV-A is irradiated, the latent image of the first pattern elements 200 of the light-emitting image 12 does not appear.

(Case of Irradiation of UV-C)

Figure 19B:
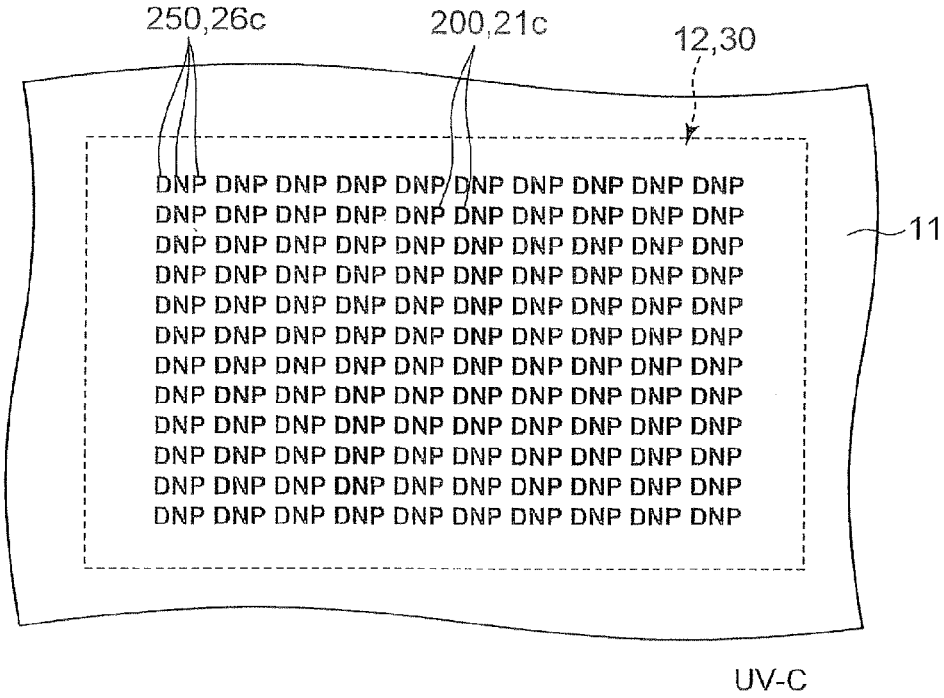
FIG. 19B is a plan view showing the light-emitting image when the UV-C is irradiated thereon, in the modification example of the fourth embodiment of the present invention.

FIG. 19B is a plan view showing the light-emitting image 12 of the anti-counterfeit medium 10 when UV-C is irradiated thereon. The first pattern elements 200 and the second pattern elements 250 are formed of the red portions 21*c* and the green portions 26*c*, respectively. Thus, when the UV-C is irradiated, the latent image of the first pattern elements 20 of the light-emitting image 12 can be viewed.

According to this modification example, since the plurality of micro-characters have some micro-characters each of which is composed of the first pattern element 200 and the second pattern element 250, the latent image of the first pattern elements 200, which has a smoother contour than that of the fourth embodiment, can be viewed upon irradiation of the UV-C. Thus, upon irradiation of the UV-C, the shape of the latent image can be more easily recognized.

Moreover, the same effects as those of the fourth embodiment can be obtained.

Another Modification Example

In this embodiment, there is described the example in which an ink containing the fluorescent material DE-RB is used as the first fluorescent ink 13 and an ink containing the fluorescent material DE-GB is used as the second fluorescent ink 14. Namely, there is described the example in which inks of a combination_1 shown in the below Table 1 are used. However, not limited thereto, inks of a combination_2 or inks of combination_3 in Table 1 may be used as the first fluorescent ink 13 and the second fluorescent ink 14. Similarly to the case of the combination_1, in the case of the combination_2 or the combination_3, the first fluorescent ink 13 and the second fluorescent ink 14 are inks which emit light of the same color or light of colors that are viewed as the same color when the UV-A is irradiated. Therefore, the latent image of the light-emitting image 12 can be prevented from being easily found out, whereby forging of the anti-counterfeit medium 10 can be made more difficult.

In this embodiment, there is described the example in which the first pattern elements 200 are formed by using the first fluorescent ink 13 and the second pattern elements 250 are formed by using the second fluorescent ink 14. However, not limited thereto, the first pattern elements 200 may be formed by using the second fluorescent ink 14, and the second pattern elements 250 may be formed by using the first fluorescent ink 13. Also in this case, the latent image of the first pattern elements 200 cannot be viewed when the UV-A is irradiated. It is not until the UV-C is irradiated that the latent image of the first pattern elements 200 can be viewed. Thus, forging of the anti-counterfeit medium 10 can be made difficult.

Fifth Embodiment

Next, a fifth embodiment of the present invention is described with reference to FIGS. 20A and 20B. The fifth embodiment shown in FIGS. 20A and 20B differs from the fourth embodiment shown in FIGS. 15 to 17B only in that the second fluorescent ink 14 is made of an ink that does not emit light when the UV-C is irradiated. The other structures are substantially the same as the aforementioned fourth embodiment. In the fifth embodiment shown in FIGS. 20A and 20B, the same parts as those of the fourth embodiment shown in FIGS. 15 to 17B are shown by the same reference numbers, and description thereof is omitted.

Next, an operation of this embodiment as structured above is described. Herein, a method of manufacturing the anti-counterfeit medium 10 is described at first. Then, there is described a method of examining whether a valuable paper made of the anti-counterfeit medium 10 is genuine or not.

Method of Manufacturing Anti-counterfeit Medium

At first, the substrate 11 is prepared. As the substrate 11, there is used a 188-μm thick substrate made of white polyethylene terephthalate. Then, with the use of the first fluorescent ink 13 and the second fluorescent ink 14, the light-emitting image 12 composed of the first pattern elements 200 and the second pattern elements 250 is formed on the substrate 11.

At this time, as described above, the first fluorescent ink 13 and the second fluorescent ink 14 in the second embodiment are used as the first fluorescent ink 13 and the second fluorescent ink 14.

Then, with the use of an overcoat ink, the overcoat layer 30 having a thickness of, e.g., 2 μm is formed on the substrate 11, the first pattern elements 200 and the second pattern elements 250. At this time, the overcoat ink in the first embodiment is used as the overcoat ink.

Next, a method of examining (confirming) whether a valuable paper made of the anti-counterfeit medium 10 is genuine or not is described with reference to FIGS. 20A and 2013.

(Case of Irradiation of UV-A)

Figure 20A:
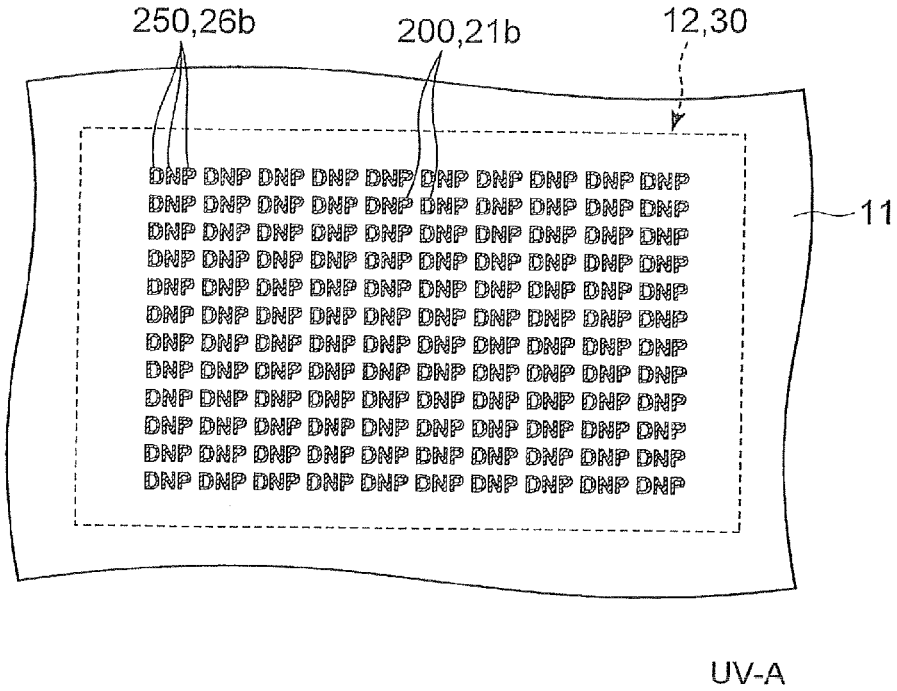
FIG. 20A is a plan view showing the light-emitting image when the UV-A is irradiated thereon, in a fifth embodiment of the present invention.

FIG. 20A is a plan view showing the light-emitting image 12 of the anti-counterfeit medium 10, when the UV-A is irradiated thereon. Since the first fluorescent ink 13 forming the first pattern elements 200 contains the fluorescent material DE-RB, the first fluorescent ink 13 emits light of blue color. Thus, the first pattern elements 200 are viewed as the blue portions 21*b*. On the other hand, since the second fluorescent ink 14 forming the second pattern elements 250 contains the fluorescent material D-1184, the second fluorescent ink 14 emits light of blue color. Thus, the second pattern elements 25 are also viewed as the blue portions 26*b*. Even when there is a difference in thickness and/or surface roughness between the first pattern element 200 and the second pattern element 250, the overcoat layer 30 obscures such a difference. Thus, the blue portions 21*b* and the blue portions 26*b* are viewed as portions of the same color. Namely, upon irradiation of the UV-A, the first pattern elements 200 and the second pattern elements 250 are viewed as micro-characters of the same color. As a result, when the UV-A is irradiated, the latent image of the first pattern elements 200 of the light-emitting image 12 does not appear.

(Case of Irradiation of UV-C)

Figure 20B:
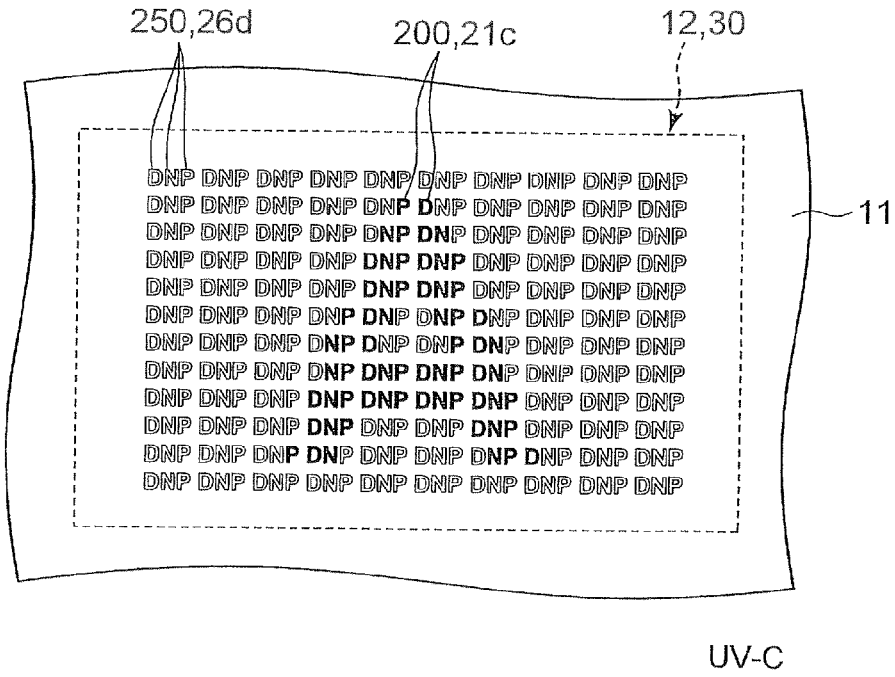
FIG. 20B is a plan view showing the light-emitting image when the UV-C is irradiated thereon, in the fifth embodiment of the present invention.

FIG. 20B is a plan view showing the light-emitting image 12 of the anti-counterfeit medium 10, when the UV-C is irradiated thereon. Since the first fluorescent ink 13 forming the first pattern elements 200 contains the fluorescent material DE-RB, the first fluorescent ink 13 emits light of red color. Thus, the first pattern elements 20 are viewed as the red portions 21*c*. On the other hand, since the second fluorescent ink 14 forming the second pattern elements 250 is made of the ink that does not emit light upon irradiation of the UV-C, the second pattern elements 250 are viewed as achromatic portions 26*d*. Thus, when the UV-C is irradiated, the latent image of the first pattern elements 200 of the light-emitting image 12 can be viewed.

Although FIG. 20B shows the lines defining the micro-characters of "D", "N" and "P" of the second pattern elements 250, these micro-characters are not viewed actually.

Modification Example

In this embodiment, there is described the example in which an ink containing the fluorescent material DE-RB is used as the first fluorescent ink 13, and an ink containing the fluorescent material D-1184 is used as the second fluorescent ink 14. Namely, the use of inks of a combination_1 in Table 2 in the second embodiment is shown by way of example. However, not limited thereto, inks of a combination_2 to a combination_6 in Table 2 may be used as the first fluorescent ink 13 and the second fluorescent ink 14. Similarly to the combination_1, the first fluorescent ink 13 and the second fluorescent ink 14 in the combination_2 to the combination_6 are inks that emit light of the same color or light of colors that are viewed as the same color when the UV-A is irradiated. Thus, the latent image of the light-emitting image 12 can be prevented from being easily found out, whereby forging of the anti-counterfeit medium 10 can be made more difficult.

In this embodiment, there is described the example in which the first pattern elements 200 are formed by using the first fluorescent ink 13 and the second pattern elements 250 are formed by using the second fluorescent ink 14. However, not limited thereto, the first pattern elements 200 may be formed by using the second fluorescent ink 14, and the second pattern elements 250 may be formed by using the first fluorescent ink 13. Also in this case, the latent image of the light-emitting image 12, which is composed of the first pattern elements 200 and the second pattern elements 250, cannot be viewed when the UV-A is irradiated. It is not until the UV-C is irradiated that the latent image of the light-emitting image 12 can be viewed. Thus, forging of the anti-counterfeit medium 10 can be made difficult.

Sixth Embodiment

Next, a sixth embodiment of the present invention is described with reference to FIGS. 21A and 21B. The sixth embodiment shown in FIGS. 21A and 21B differs from the fourth embodiment shown in FIGS. 15 to 17B only in that the first fluorescent ink and the second fluorescent ink are selected such that the first fluorescent ink and the second fluorescent ink emit light of the same color or light of colors that are viewed as the same color when the UV-C is irradiated. The other structures are substantially the same as the aforementioned fourth embodiment shown in FIGS. 15 to 17B. The first fluorescent ink and the second fluorescent ink are the same as the first fluorescent ink and the second fluorescent ink of the third embodiment. In the sixth embodiment shown in FIGS. 21A and 21B, the same parts as those of the fourth embodiment shown in FIGS. 15 to 17B are shown by the same reference numbers, and description thereof is omitted.

Next, an operation of this embodiment as structured above is described. Herein, a method of manufacturing the anti-counterfeit medium 10 is firstly described. Then, there is described a method of examining whether a valuable paper made of the anti-counterfeit medium 10 is genuine or not.

Method of Manufacturing Anti-counterfeit Medium

At first, the substrate 11 is prepared. As the substrate 11, there is used a 188-μm thick substrate made of white polyethylene terephthalate. Then, by using the first fluorescent ink 13 and the second fluorescent ink 14, the light-emitting image 12 composed of the first pattern elements 200 and the second pattern elements 250 is formed on the substrate 11.

At this time, as described above, the first fluorescent ink 13 and the second fluorescent ink 14 in the third embodiment are used as the first fluorescent ink 13 and the second fluorescent ink 14.

Then, with the use of an overcoat ink, the overcoat layer 30 having a thickness of, e.g., 2 μm is formed on the substrate 11, the first pattern elements 200 and the second pattern elements 250. At this time, the overcoat ink in the first embodiment is used as the overcoat ink.

Confirmation Method

Next, a method of examining (confirming) whether a valuable paper made of the anti-counterfeit medium 10 is genuine or not is described with reference to FIGS. 21A and 21B.

(Case of Irradiation of UV-C)

Figure 21A:
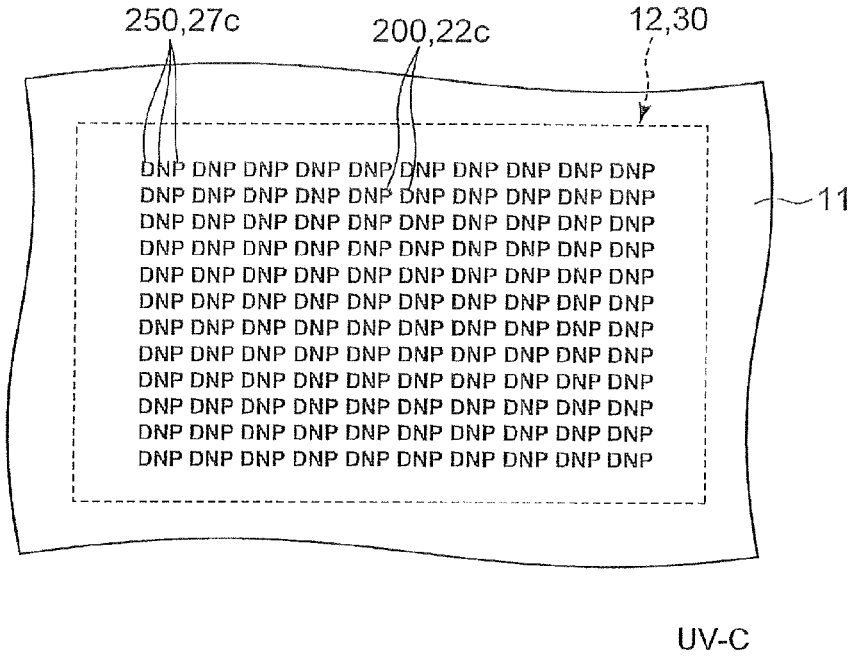
FIG. 21A is a plan view showing the light-emitting image when the UV-C is irradiated thereon, in a sixth embodiment of the present invention.

FIG. 21A is a plan view showing the light-emitting image of the anti-counterfeit medium 10 when the UV-C is irradiated thereon. Since the first fluorescent ink 13 forming the first pattern elements 200 contains the fluorescent material DE-GB, the first fluorescent ink 13 emits light of green color. Thus, the first pattern elements 200 are viewed as the green portions 22*c*. On the other hand, since the second fluorescent ink 14 forming the second pattern elements 250 contains the fluorescent material DE-GR, the second fluorescent ink 14 emits light of green color. Thus, the second pattern elements 25 are also viewed as green portions 27*c*. As described above, even when there is a difference in thickness and/or surface roughness between the first pattern element 200 and the second pattern element 250, the overcoat layer 30 obscures such a difference. Thus, the green portions 22*c* and the green portions 27*c* are viewed as portions of the same color. Namely, when the UV-C is irradiated, the first patter elements 200 and the second pattern elements 250 are viewed as micro-characters of the same color. As a result, when the UV-C is irradiated, the latent image of the first pattern elements 200 of the light-emitting image 12 does not appear.

(Case of Irradiation of UV-A)

Figure 21B:
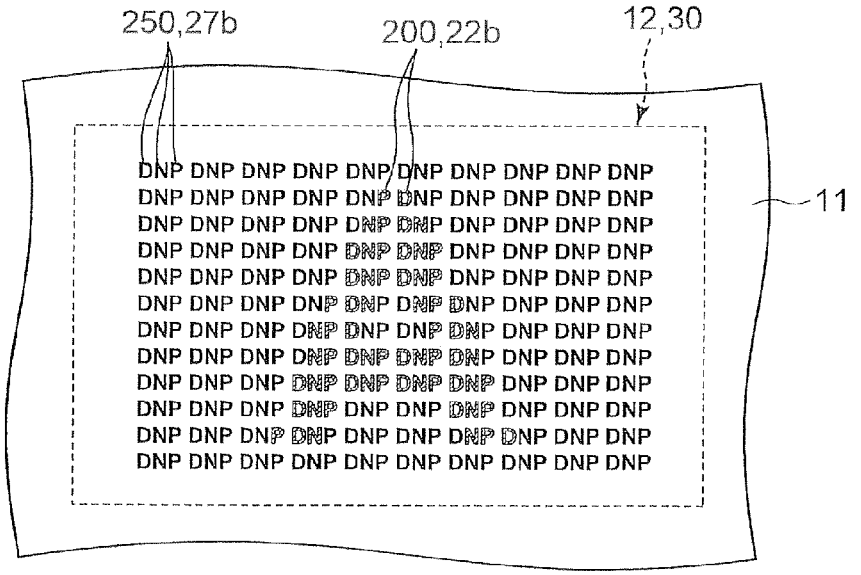
FIG. 21B is a plan view showing the light-emitting image when the UV-A is irradiated thereon, in the sixth embodiment of the present invention.

FIG. 21B is a plan view showing the light-emitting image of the anti-counterfeit medium 10 when the UV-A is irradiated thereon. Since the first fluorescent ink 13 forming the first pattern elements 200 contains the fluorescent material DE-GB, the first fluorescent ink 13 emits light of blue color. Thus, the first pattern elements 200 are viewed as the blue portions 22*b*. On the other hand, the second fluorescent ink 14 forming the second pattern elements 250 contains the fluorescent material DE-GR, the second fluorescent ink 14 emits light of red color. Thus, the second pattern elements 250 are viewed as red portions 27*b*. Namely, when the UV-A is irradiated, the first pattern elements 200 and the second pattern elements 250 are viewed as micro-characters of different colors. As a result, when the UV-A is irradiated, the latent image of the first pattern elements 200 of the light-emitting image 12 can be viewed.

According to the fourth to sixth embodiments, the anti-counterfeit medium 10 includes the substrate 11, the plurality of first pattern elements 200 formed on the substrate 11 by using the first fluorescent ink 13 containing the first fluorescent material, and the plurality of second pattern elements 250 formed on the substrate 11 by using the second fluorescent ink 14 containing the second fluorescent material. The first pattern elements 200 and the second pattern elements 250 form a plurality of micro-characters of "D", "N" and "P". The micro-characters form the plurality of micro-character rows m, and the first pattern elements 200 form the latent image in the micro-character rows m. The overcoat layer 30 transmits therethrough the UV-A and the UV-C. In the fourth and fifth embodiments, the first fluorescent material of the first fluorescent ink 13 is made of the fluorescent material DE-RB which emits light of blue color (first color) when the UV-A is irradiated, and emits light of red color (second color) when the UV-C is irradiated. Meanwhile, in the fourth embodiment, the second fluorescent material of the second fluorescent ink 14 is made of the fluorescent material DE-GB which emits light of blue color (first color) or light of a color that is viewed as the same color as the blue color (first color) when the UV-A is irradiated, and emits light of green color (third color) when the UV-C is irradiated. In the fifth embodiment, the second fluorescent material of the second fluorescent ink 14 is made of the fluorescent material D-1184 which emits light of blue color (first color) or light of a color that is viewed as the same color as the blue color (first color) when the UV-A is irradiated, and does not emit light when the UV-C is irradiated. In the sixth embodiment, the first fluorescent material of the first fluorescent ink 13 is made of the fluorescent material DE-GB which emits light of green color (first color) when the UV-C is irradiated, and emits light of blue color (second color) when the UV-A is irradiated. Meanwhile, the second fluorescent material of the second fluorescent ink 14 is made of the fluorescent material DE-GR which emits light of green color (first color) or light of a color that is viewed as the same color as the green color (first color) when the UV-C is irradiated, and emits light of red color (third color) when the UV-A is irradiated. Thus, according to the fourth and fifth embodiments, the first pattern elements 200 and the second pattern elements 250 are not discriminated when the UV-A is irradiated. It is not until the UV-C is irradiated that the first pattern elements 200 and the second pattern elements 250 can be discriminated. Namely, when the UV-A is irradiated, the latent image of the first pattern elements 200 is buried in the micro-character rows m and thus cannot be viewed. It is not until the UV-C is irradiated that the latent image of the first pattern elements 200 appears in the micro-character rows m and thus can be viewed. According to the sixth embodiment, the first pattern elements 200 and the second pattern elements 250 are not discriminated when the UV-C is irradiated. It is not until the UV-A is irradiated that the first pattern elements 200 and the second pattern elements 250 can be discriminated, Namely, when the UV-C is irradiated, the latent image of the first pattern elements 200 is buried in the micro-character rows m and thus cannot be viewed. It is not until the UV-A is irradiated that the latent image of the first pattern elements 200 appears in the micro-character rows m and thus can be viewed.

In this manner, by forming the first pattern elements 200 and the second pattern elements 250 with the use of inks containing the dichromic fluorescent materials, forging of the anti-counterfeit medium 10 can be made difficult as compared with a case in which an ink containing a monochromatic fluorescent material is used. In addition, whether the light-emitting image 12 is genuine or not can be easily and promptly judged by the naked eye.

In addition, by selecting the first fluorescent material of the first fluorescent ink 13 and the second fluorescent material of the second fluorescent ink 14 such that the first fluorescent ink 13 and the second fluorescent ink 14 emit light of the same color or light of colors that are viewed as the same color, when the UV-A is irradiated (fourth and fifth embodiments) or when the UV-C is irradiated (sixth embodiment), the latent image of the light-emitting image 12 can be prevented from being easily found out. Therefore, forging of the anti-counterfeit medium 10 can, be made more difficult.

In addition, in the fourth and fifth embodiments, since preparation of a light source of the UV-C is more difficult than that of UV-A, by selecting the first fluorescent material and the second fluorescent material of the first fluorescent ink 13 and the second fluorescent ink 14 such that it is not until the UV-C is irradiated that the latent image of the first pattern elements 200 appears, the latent image of the first pattern elements 200 can be more securely prevented from being found out. Therefore, forging of the anti-counterfeit medium 10 can be made furthermore difficult.

Further, in the respective fourth to sixth embodiments, since the first pattern elements 200 and the second pattern elements 250 form the plurality of micro-character rows m, surfaces areas of the first pattern elements 200 and the second pattern elements 250 are smaller than a surface area of the light-emitting image 12. In addition, the first pattern element 200 and the second pattern element 250 have the complicated shapes. Thus, even when there is a slight color difference or a thickness difference between the first pattern element 200 and the second pattern element 250, the latent image of the first pattern elements 200 is difficult to be viewed when the UV-A is irradiated (fourth and fifth embodiments) or when the UV-C is irradiated (sixth embodiment). That is to say, the latent image of the light-emitting image 12 can be prevented from being easily found out. Therefore, forging of the anti-counterfeit medium 10 can be made furthermore difficult.

In addition, in the respective fourth to sixth embodiments, there is no portion where the first pattern element 200 and the second pattern element 250 are in contact with each other. Namely, in the fourth and fifth embodiments, when the UV-A is irradiated, there is no portion where the blue portion 21*b* of the first pattern element 200 and the blue portion 26*b* of the second pattern element 250 are in contact with each other. In the sixth embodiment, when the UV-C is irradiated, there is no portion where the green portion 22*c* of the first pattern element 200 and the green portion 27*c* of the second pattern element 250 are in contact with each other. Assuming that first pattern element 200 and the second pattern element 250 are in contact with each other, there is a possibility that light which is randomly reflected or refracted exits at the portion where the first pattern element 200 and the second pattern element 250 are in contact with each other. However, according to the respective fourth to sixth embodiments, there is no possibility that the boundary between the first pattern element 200 and the second pattern element 250 is viewed as a result of such light. Therefore, the latent image of the first pattern elements 200 can be more securely prevented from being found out.

Furthermore, even when there is a difference in thickness and/or surface roughness between the first pattern element 200 and the second pattern element 250, the overcoat layer 30 obscures such a difference. Thus, when the UV-A (fourth and fifth embodiments) or the UV-C (sixth embodiment) is irradiated, the first pattern elements 200 and the second pattern elements 200 are viewed as elements of the same color. Therefore, the latent image of the first pattern elements 20 can be more securely prevented from being found out, whereby forging of the anti-counterfeit medium 10 can be made more difficult.

Modification Example

In this embodiment, there is described the example in which an ink containing the fluorescent material DE-GB is used as the first fluorescent ink 13, and an ink containing the fluorescent material DE-GR is used as the second fluorescent ink 14. Namely, the use of inks of a combination_1 in the Table 3 in the third embodiment is shown by way of example. However, not limited thereto, inks of a combination_2 or a combination_3 in Table 3 may be used as the first fluorescent ink 13 and the second fluorescent ink 14. Similarly to the combination_1, the first fluorescent ink 13 and the second fluorescent ink 14 in the combination_2 or the combination_3 are inks that emit light of the same color or light of colors that are viewed as the same color when the UV-A is irradiated. Thus, the latent image of the light-emitting image 12 can be prevented from being easily found out, whereby forging of the anti-counterfeit medium 10 can be made more difficult.

Another Embodiment

In this embodiment, there is described the example in which the second fluorescent ink 14 is made of a dichromatic fluorescent material. However, not limited thereto, similarly to the fifth embodiment shown in FIGS. 20A and 20B, the second fluorescent ink 14 may be made of a monochromatic fluorescent material. The combination of the first fluorescent ink 13 and the second fluorescent ink 14 is not particularly limited, and various combinations may be suitably selected as shown in the below Table 4.

In this embodiment, there is described the example in which the first pattern elements 200 are formed by using the first fluorescent ink 13 and the second pattern elements 250 are formed by using the second fluorescent ink 14. However, not limited thereto, the first pattern elements 200 may be formed by using the second fluorescent ink 14, and the second pattern elements 250 may be formed by using the first fluorescent ink 13. Also in this case, the latent image of the light-emitting image 12, which is composed of the first pattern elements 200 and the second pattern elements 150, cannot be viewed when the UV-C is irradiated. It is not until the UV-A is irradiated that the latent image of the light-emitting image 12 can be viewed. Thus, forging of the anti-counterfeit medium 10 can be made difficult.

In the respective first to sixth embodiments, there is described the example in which the color of light emitted from the first fluorescent ink 13 or the second fluorescent ink 14 is any of the blue color, the red color and the green color. However, not limited thereto, as the inks 13 and 14, there may be used inks of various combinations that are viewed as inks of the same color when the invisible light within the first wavelength range is irradiated, and viewed as inks of different colors when the invisible light within the second wavelength range is irradiated.

In addition, in the respective first to sixth embodiments, there is described the example in which the overcoat layer 30 is substantially achromatic and transparent. However, not limited thereto, the overcoat layer 30 may be colored, as long as the pattern area 20 and the background area 25 (the first pattern elements 200 and the second pattern elements 250) are viewed as areas (micro-characters) of the same color under the visible light or when the invisible light within the first wavelength is irradiated, and the pattern area 20 and the background area 25 (the first pattern elements 200 and the second pattern elements 250) are viewed as areas (micro-characters) of different colors when the invisible light within the second wavelength is irradiated.

In the above respective first to sixth embodiments, there is described the example in which, when the invisible light within the second wavelength range is irradiated, the first fluorescent material emits light of the second color, and the second fluorescent material emits light of the third color or does not emit light, whereby the pattern area 20 containing the first fluorescent material and the background area 25 containing the second fluorescent material (the first pattern elements 200 containing the first fluorescent material and the second pattern elements 250 containing the second fluorescent material) are viewed as areas (pattern elements) of different colors from each other. However, the present invention is not limited thereto.

Namely, the color of light emitted from the first fluorescent color can be optionally set, as long as, when the invisible light within the first wavelength range is irradiated, the first fluorescent material and the second fluorescent material emit light of colors that are viewed as the same color with each other, and when the invisible light within the second wavelength range is irradiated, the pattern area 20 containing the first fluorescent material and the background area 25 containing the second fluorescent material (the first pattern elements 200 containing the first fluorescent material and the second pattern elements 250 containing the second fluorescent material) are viewed as areas (pattern elements) of different colors from each other.

For example, there may be used the first fluorescent material which emits light of the first color when the first invisible light within the first wavelength range is irradiated, and also emits light of the first color or light of a color that is viewed as the same color as the first color when the invisible light within the second wavelength range is irradiated. In this case, when the invisible light within the first wavelength range is irradiated, the first fluorescent material emits light of the first color, and the second fluorescent material emits light of the first color or light of a color that is viewed as the same color as the first color. Thus, the pattern area 20 and the background area 25 (the first pattern elements 200 and the second pattern elements 250) are viewed as areas (pattern elements) of the same color with each other. On the other hand, when the invisible light within the second wavelength range is irradiated, the first fluorescent material emits light of the first color or light of a color that is viewed as the same color as the first color, and the second fluorescent material emits light of the third color or does not emit light. Thus, the pattern area 20 and the background area 25 (the first pattern elements 200 and the second pattern elements 250) are viewed as areas (pattern elements) of colors different from each other. Therefore, in the first to third embodiments, the pattern of the light-emitting image composed of the pattern area 20 and the background area 25 is not viewed when the invisible light within the first wavelength range is irradiated. It is not until the invisible light within the second wavelength range, the pattern of the light-emitting image composed of the pattern area 20 and the background area 25 can be viewed. In the fourth to sixth embodiments, when the invisible light within the first wavelength range is irradiated, the latent image of the light-emitting image formed by the first pattern elements is buried in the micro-character rows, and thus cannot be viewed. It is not until the invisible light of the second wavelength range is irradiated that the latent image of the light-emitting image appears in the micro-character rows and thus can be viewed. Accordingly, the light-emitting image can be easily and promptly confirmed, and the pattern of the light-emitting image can be prevented from being easily found out.

Seventh Embodiment

In the respective above embodiments, the pattern (the latent image) of the pattern area 20 (the first pattern elements 200) cannot be viewed when one of the UV-A and the UV-C is irradiated, but can be viewed when the other of the UV-A and the UV-C is irradiated. However, the pattern (the latent image) of the pattern area 20 (the first pattern elements 200) may not be viewed upon irradiation of the UV-A or the UV-C, but may be viewed only when the UV-A and the UV-C are simultaneously irradiated.

At this time, the first fluorescent ink 13 emits light having a peak wavelength of about 610 nm, which is light of red color (first color), when the UV-A is irradiated, and emits light having a peak wavelength of about 520 nm, which is light of green color (second color), when the UV-C is irradiated. When the UV-A and the UV-C are simultaneously irradiated, the first fluorescent ink 13 emits light of yellow color (fifth color). For example, the aforementioned fluorescent material DE-GR can be used as the first fluorescent ink 13.

Meanwhile, the second fluorescent ink 14 emits light having a peak wavelength (emission wavelength) of about 615 nm, which is light of red color (third color) when the UV-A is irradiated, and emits light having a peak wavelength of about 515 nm, which is light of green color (fourth color), when the UV-C is irradiated. When the UV-A and the UV-C are simultaneously irradiated, the second fluorescent ink 14 emits light of yellow color (sixth color). As the second fluorescent ink 14, there may be used a fluorescent medium DE-GR1 (manufactured by Nemoto & Co., Ltd.) which has an emission wavelength that is different from that of the fluorescent material DE-GR by not more than 5 nm. Namely, the emission wavelength on the side of a short wavelength of the fluorescent material DE-GR1 is smaller than that of DE-GR by about 5 nm, and the emission wavelength on the side of a long wavelength thereof is larger than that of DE-GR by about 5 mm.

The red color (first color) having a peak wavelength of about 610 nm and the red color (third color) having a peak wavelength of about 615 nm are viewed as the same color. In addition, the green color (second color) having a peak wavelength of about 520 nm and the green color (fourth color) having a wavelength of about 515 nm are viewed as the same color.

On the other hand, when the UV-A and the UV-C are simultaneously irradiated, since a color difference $\Delta E^*_{ab}$ between the light of the yellow color (fifth color) emitted by the first fluorescent ink 13 and light of the yellow color (sixth color) emitted by the second fluorescent ink 14 is about 12, the former yellow color and the latter yellow color are viewed as different colors.

Since the first fluorescent ink 13 contains the fluorescent medium DE-GR and the second fluorescent ink 14 contains the fluorescent medium DE-GR1, when only the UV-A is irradiated, the pattern area 20 and the background area 25 (the first pattern elements 200 and the second pattern elements 250) are viewed as areas (micro-characters) of the same color (red color). Therefore, the pattern (the latent image) of the pattern area 20 (the first pattern elements 200) of the light-emitting image 12 does not appear. When only the UV-C is irradiated, the pattern area 20 and the background area 25 (the first pattern elements 200 and the second pattern elements 250) are viewed as areas (micro-characters) of the same color (green color). Therefore, the pattern (the latent image) of the pattern area 20 (the first pattern elements 200) of the light-emitting image 12 does not appear. When the UV-A and the UV-C are simultaneously irradiated, the pattern area 20 and the background area 25 (the first pattern elements 200 and the second pattern elements 250) are viewed as areas (micro-characters) of yellow colors that are different from each other. Therefore, the pattern (the latent image) of the pattern area 20 (the first pattern elements 200) of the light-emitting image 12 can be viewed.

That is to say, similarly to the first to third embodiments, when the light-emitting image 12 is composed of the pattern area 20 and the background area 25, the pattern of the pattern area 20 is not viewed when the UV-A is irradiated or when the UV-C is irradiated. It is not until the UV-A and the UV-C are simultaneously irradiated that the pattern of the pattern area 20 can be viewed.

Meanwhile, similarly to the fourth to sixth embodiments, in the case where the light-emitting image 12 is composed of micro-characters, the latent pattern of the first pattern elements 200 is buried in the micro-character rows m and thus is not viewed when the UV-A is irradiated or when the UV-C is irradiated. It is not until the UV-A and the UV-C are simultaneously irradiated that the latent image of the first pattern elements 200 appears and thus can be viewed.

In this manner, forging of the anti-counterfeit medium 10 can be made more difficult, by selecting the dichromatic fluorescent material contained in the ink forming the pattern area 20 (the first pattern elements 200) and the dichromatic fluorescent material contained in the ink forming the background area 25 (the second pattern elements 250) such that an emission wavelength difference therebetween is not more than 5 nm.

Further, even when there is a difference in thickness and/or surface roughness between the pattern area 20 of the light-emitting image 12 and the background area 25 thereof (the first pattern element 200 and the second pattern element 250), the overcoat layer 30 obscures such a difference. Thus, when the UV-A is irradiated or when the UV-C is irradiated, the pattern area 20 and the background area 25 (the first pattern elements 200 and the second pattern elements 250) are viewed as areas (micro-characters) of the same color. Thus, the pattern (latent image) of the light-emitting image 12 can be more securely prevented from being easily found out. As a result, forging of the anti-counterfeit medium 10 can be made furthermore difficult.

Further, similarly to the fourth to sixth embodiments, when the light-emitting image 12 is composed of the micro-characters, the first pattern elements 200 and the second pattern elements 250 form the plurality of micro-character rows m. Thus, even when there is a slight color difference or thickness difference between the first pattern element 200 and the second pattern element 250, the latent image of the first pattern elements 20 is difficult to be viewed, upon irradiation of the UV-A or upon irradiation of the UV-C. Namely, since the latent image of the light-emitting image 12 can be prevented from being easily found out, forging of the anti-counterfeit medium 10 can be made furthermore difficult.

The fluorescent medium DE-RB may be used as the first fluorescent ink 13, and a fluorescent medium DE-RB1 (manufactured by Nemoto & Co., Ltd), which has an emission wavelength that is different from that of the fluorescent material DE-RB by not more than 5 nm, may be used as the second fluorescent ink 14. In this case, upon irradiation of the UV-A, the pattern area 20 and the background area 25 (the first pattern elements 200 and the second pattern elements 250) are viewed as areas (micro-characters) of the same color (blue color). Therefore, the pattern (the latent image) of the pattern area 20 (the first pattern elements 200) does not appear. Upon irradiation of the UV-C, the pattern area 20 and the background area 25 (the first patter elements 200 and the second pattern elements 250) are viewed as areas (micro-characters) of the same color (red color). Therefore, the pattern (the latent image) of the pattern area 20 (the first pattern elements 200) does not appear. Upon simultaneous irradiation of the UV-A and the UV-C, the pattern area 20 and the background area 25 (the first pattern elements 200 and the second pattern elements 250) are viewed as areas (micro-characters) of magenta colors that are different from each other. Therefore, the pattern (the latent image) of the pattern area 20 (the first pattern elements 200) can be viewed.

The fluorescent medium DE-BG may used as the first fluorescent ink 13, and a fluorescent medium DE-BG1 (manufactured by Nemoto & Co., Ltd), which has an emission wavelength that is different from that of the fluorescent material DE-BG by not more than 5 nm, may be used as the second fluorescent ink 14. In this case, upon irradiation of the UV-A, the pattern area 20 and the background area 25 (the first pattern elements 200 and the second pattern elements 250) are viewed as areas (micro-characters) of the same color (green color). Therefore, the pattern (the latent image) of the pattern area 20 (the first pattern elements 200) does not appear. Upon irradiation of the UV-C, the pattern area 20 and the background area 25 (the first patter elements 200 and the second pattern elements 250) are viewed as areas (micro-characters) of the same color (blue color). Therefore, the pattern (the latent image) of the pattern area 20 (the first pattern elements 200) does not appear. Upon simultaneous irradiation of the UV-A and the UV-C, the pattern area 20 and the background area 25 (the first pattern elements 200 and the second pattern elements 250) are viewed as areas (micro-characters) of cyan colors that are different from each other. Therefore, the pattern (the latent image) of the pattern area 20 (the first pattern elements 200) can be viewed.

Eighth Embodiment

When the UV-A is irradiated or when the UV-C is irradiated, the pattern (the latent image) of the pattern area 20 (the first pattern elements 200) may be viewed, and when the UV-A and the UV-C are simultaneously irradiated, the pattern (the latent image) of the pattern area 20 (the first pattern elements 200) may disappear (not be viewed).

For example, the anti-counterfeit medium 10 is formed by using the above-described fluorescent material DE-RG as the first fluorescent ink 13 and by using the above-described fluorescent material DE-GR as the second fluorescent ink 14. Such an anti-counterfeit medium 10 is viewed as white as a whole under the visible light, and the pattern (the latent image) of the pattern area 20 (the first pattern elements 200) does not appear.

When only the UV-A is irradiated on the anti-counterfeit medium 10, the first fluorescent ink 13 (fluorescent material DE-RG) forming the pattern area 20 (the first pattern elements 200) emits light of green color. On the other hand, the second fluorescent ink 14 (fluorescent material DE-GR) forming the background area 25 (the second pattern elements 250) emits light of red color. Thus, the pattern area 20 and the background area 25 (the first pattern elements 200 and the second pattern elements 250) are viewed as areas (micro-characters) of different colors. Therefore, similarly to the first to third embodiments, when the light-emitting image 12 is composed of the pattern area 20 and the background area 25, the pattern of the pattern area 20 of the light-emitting image 12 can be viewed, upon irradiation of the UV-A. In addition, similarly to the fourth to sixth embodiments, when the light-emitting image 12 is composed of the micro-characters, the latent image of the first pattern elements 200 of the light-emitting image 12 appears in the micro-character rows m and thus can be viewed, upon irradiation of the UV-A.

When only the UV-C is irradiated on the anti-counterfeit medium 10, the first fluorescent ink 13 (fluorescent material DE-RG) forming the pattern area 20 (the first pattern elements 200) emits light of red color. On the other hand, the second fluorescent ink 14 (fluorescent material DE-GR) forming the background area 25 (the second pattern elements 250) emits light of green color. Thus, the pattern area 20 and the background area 25 (the first pattern elements 200 and the second pattern elements 250) are viewed as areas (micro-characters) of different colors. Therefore, upon irradiation of the UV-C, the pattern (the latent image) of the pattern area 20 (the first pattern elements 200) of the light-emitting image 12 can be viewed.

When the UV-A and the UV-C are simultaneously irradiated on the anti-counterfeit medium 10, the first fluorescent ink 13 (fluorescent material DE-RG) forming the pattern area 20 (the first pattern elements 200) emits light of yellow color. Similarly, the second fluorescent ink 14 (fluorescent material DE-GR) forming the background area 25 (the second pattern elements 250) emits light of yellow color. Thus, the pattern area 20 and the background area 25 (the first pattern elements 200 and the second pattern elements 250) are viewed as areas (micro-characters) of the same color. Therefore, similarly to the first to third embodiments, when the light-emitting image 12 is composed of the pattern area 20 and the background area 25, the pattern of the pattern area 20 of the light-emitting image 12 does not appear, upon simultaneous irradiation of the UV-A and the UV-C. In addition, similarly to the fourth to sixth embodiments, when the light-emitting image 12 is composed of the micro-characters, the latent image of the first pattern elements 200 of the light-emitting image 12 is buried in the micro-character ranges m and thus does not appear, upon simultaneous irradiation of the UV-A and the UV-C.

In this manner, since the light-emitting image 12 varies along with the respective three irradiation patterns, i.e., the irradiation of UV-A, the irradiation of UV-C and the simultaneous irradiation of UV-A and UV-C, in such a manner that the pattern (the latent image) of the pattern area 20 (the first pattern elements 200) does not appear upon simultaneous irradiation of UV-A and UV-C, forging of the anti-counterfeit medium 10 can be made furthermore difficult.

Further, even when there is a difference in thickness and/or surface roughness between the pattern area 20 and the background area 25 (the first pattern element 200 and the second pattern element 250) of the light-emitting image 12, the overcoat layer 30 obscures such a difference. Thus, upon simultaneous irradiation of the UV-A and the UV-C, the pattern area 20 and the background area 25 (the first patter elements 200 and the second pattern elements 250) are viewed as areas (micro-characters) of the same color. Namely, the light-emitting image 12 can more reliably vary in the respective three irradiation patterns. Thus, forging of the anti-counterfeit medium 10 can be made furthermore difficult.

Furthermore, similarly to the fourth to sixth embodiments, when the light-emitting image 12 is composed of the micro-characters, the first pattern elements 200 and the second pattern elements 250 form the plurality of micro-character rows m. Thus, even when there is a slight color difference or thickness difference between the first pattern element 200 and the second pattern element 250, the latent image of the first pattern elements 200 is difficult to be viewed, upon simultaneous irradiation of the UV-A and the UV-C. Namely, the light-emitting image 12 can more reliably vary in the respective three irradiation patterns. Thus, forging of the anti-counterfeit medium 10 can be made furthermore difficult.

The fluorescent medium DE-RB may be used as the first fluorescent ink 13, and the fluorescent medium DE-BR may be used as the second fluorescent ink 14. In this case, upon irradiation of the UV-A, the first fluorescent ink 13 (fluorescent material DE-RB) forming the pattern area 20 (the first pattern elements 200) emits light of blue color, and the second fluorescent ink 14 (fluorescent material DE-BR) forming the background area 25 (the second fluorescent elements 250) emits light of red color. Thus, the pattern area 20 and the background area 25 (the first pattern elements 200 and the second pattern elements 250) are viewed as areas (micro-characters) of different colors. Therefore, the pattern (the latent image) of the pattern area 20 (the first pattern elements 200) can be viewed. Upon irradiation of the UV-C, the first fluorescent ink 13 (fluorescent material DE-RB) forming the pattern area 20 (the first pattern elements 200) emits light of red color, and the second fluorescent ink 14 (fluorescent material DE-BR) forming the background area 25 (the second fluorescent elements 250) emits light of blue color. Thus, the pattern area 20 and the background area 25 (the first pattern elements 200 and the second pattern elements 250) are viewed as areas (micro-characters) of different colors. Therefore, the pattern (the latent image) of the pattern area 20 (the first pattern elements 200) can be viewed. Upon simultaneous irradiation of the UV-A and the UV-C, the pattern area 20 and the background area 25 (the first pattern elements 200 and the second pattern elements 250) are viewed as areas (micro-characters) of the same magenta color. Therefore, the pattern (the latent image) of the pattern area 20 (the first pattern elements 200) does not appear.

The fluorescent medium DE-BG may be used as the first fluorescent ink 13, and the fluorescent medium DE-GB may be used as the second fluorescent ink 14. In this case, upon irradiation of the UV-A, the first fluorescent ink 13 (fluorescent material DE-BG) forming the pattern area 20 (the first pattern elements 200) emits light of green color, and the second fluorescent ink 14 (fluorescent material DE-GB) forming the background area 25 (the second fluorescent elements 250) emits light of blue color. Thus, the pattern area 20 and the background area 25 (the first pattern elements 200 and the second pattern elements 250) are viewed as areas (micro-characters) of different colors. Therefore, the pattern (the latent image) of the pattern area 20 (the first pattern elements 200) of the light-emitting image 12 can be viewed. Upon irradiation of the UV-C, the first fluorescent ink 13 (fluorescent material DE-BG) forming the pattern area 20 (the first pattern elements 200) emits light of blue color, and the second fluorescent ink 14 (fluorescent material DE-GB) forming the background area 25 (the second fluorescent elements 250) emits light of green color. Thus, the pattern area 20 and the background area 25 (the first pattern elements 200 and the second pattern elements 250) are viewed as areas (micro-characters) of different colors. Therefore, the pattern (the latent image) of the pattern area 20 (the first pattern elements 200) of the light-emitting image 12 can be viewed. Upon simultaneous irradiation of the UV-A and the UV-C, the pattern area 20 and the background area 25 (the first pattern elements 200 and the second pattern elements 250) are viewed as areas (micro-characters) of the same cyan color. Therefore, the pattern (the latent image) of the pattern area 20 (the first pattern elements 200) does not appear.

Further, when the fluorescent material DE-RG is used as the first fluorescent ink 13 and the fluorescent material DE-GR is used as the second fluorescent ink 14 is used, an ink of yellow color may be offset-printed on the substrate 11, and the first fluorescent ink 13 and the second fluorescent ink 14 may be offset-printed thereon. Similarly, when the fluorescent medium DE-RB is used as the first fluorescent ink 13 and the fluorescent medium DE-BR is used as the second fluorescent ink 14, an ink of magenta color may be offset-printed on the substrate 11, and the first fluorescent ink 13 and the second fluorescent ink 14 may be offset-printed thereon. Similarly, when the fluorescent medium DE-BG is used as the first fluorescent ink 13 and the fluorescent medium DE-GB is used as the second fluorescent ink 14, an ink of cyan color may be offset-printed on the substrate 11, and the first fluorescent ink 13 and the second fluorescent ink 14 may be offset-printed thereon. This operation facilitates that the light-emitting image 12 is viewed as a monochromatic image as a whole, upon simultaneous irradiation of the UV-A and the UV-C.

In the above respective fifth to eighth embodiments, similarly to the modification example of the fourth embodiment shown in FIGS. 18A to 19B, one micro-character may be formed to include the first pattern element 200 and the second pattern element 250.

In the above respective first to eighth embodiments, there is described the example in which inks having excitation properties to the UV-A or the UV-C are used as the first fluorescent ink 13 and the second fluorescent ink 14. However, not limited thereto, inks having excitation properties to UV-B or infrared light may be used as the first fluorescent ink 13 and the second fluorescent ink 14. Namely, invisible light within an optional wavelength range may be used as the "invisible light within a first wavelength range" or the "invisible light within a second wavelength range".

In the above respective first to third, seventh and eighth embodiments, it is sufficient that at least a part of the background area 25 is adjacent to the pattern area 20.

In the above respective embodiments, there is described the example in which the pattern area 20 and the background area 25 (the first pattern elements 200 and the second pattern elements 250) are respectively viewed as areas (micro-characters) of white color under the visible light. However, not limited thereto, it is sufficient that the pattern area 20 and the background area 25 (the first pattern elements 200 and the second pattern elements 250) are viewed as areas (micro-characters) of the same color, at least under the visible light.

In the respective fourth to eighth embodiments, the latent image may be a figure or the like.

In the respective seventh and eighth embodiments, the color of light emitted from the first fluorescent ink 13 or the second fluorescent 14 is any of the blue color, the red color and the green color, when the invisible light within the first wavelength range or the invisible light within the second wavelength range is independently irradiated. However, not limited thereto, in the seventh embodiment, as the inks 13 and 14, various combinations of inks that are viewed as inks of the same color when the invisible light within the first wavelength range or the invisible light within the second wavelength range is independently irradiated, and viewed as inks of different colors when the invisible light within the first wavelength range and the invisible light within the second wavelength range are simultaneously irradiated. In the eighth embodiment, there may be used, as the inks 13 and 14, various combinations of inks that are viewed as inks of different colors when the invisible light within the first wavelength range or the invisible light within the second wavelength range is independently irradiated, and viewed as inks of the same color when the invisible light within the first wavelength range and the invisible light within the second wavelength range are simultaneously irradiated.

In the seventh embodiment, the overcoat layer 30 may be colored, as long as the pattern area 20 and the background area 25 (the first pattern elements 200 and the second pattern elements 250) are viewed as areas (micro-characters) of the same color under the visible light or when the invisible light within the first wavelength range or the invisible light within the second wavelength range is irradiated, and the pattern area 20 and the background area 25 (the first pattern elements 200 and the second pattern elements 250) are viewed as areas (micro-characters) of different colors when the invisible light within the first wavelength range and the invisible light within the second wavelength range are simultaneously irradiated. In addition, in the eighth embodiment, the overcoat layer 30 may be colored, as long as the pattern area 20 and the background area 25 (the first pattern elements 200 and the second pattern elements 250) are viewed as areas (micro-characters) of different colors under the visible light or when the invisible light within the first wavelength range or the invisible light within the second wavelength range is irradiated, and the pattern area 20 and the background area 25 (the first pattern elements 200 and the second pattern elements 250) are viewed as areas (micro-characters) of the same color when the invisible light within the first wavelength range and the invisible light within the second wavelength range are simultaneously irradiated.

In the above respective first to eighth embodiments, there is described the example in which the light-emitting medium of the present invention is used as the anti-counterfeit medium constituting a valuable paper and so on. However, not limited thereto, the light-emitting medium of the present invention can be used in various other applications such as a toy. Also in this case, various functions or qualities can be given to the toy or the like, by the light-emitting image composed of the pattern area and the background area (the first pattern elements and the second pattern elements) which vary when at least one of the invisible light within the first wavelength range and the invisible light within the second wavelength range is irradiated thereon.

The invention claimed is:

1. A light-emitting medium including a light-emitting image on a substrate wherein:

the light-emitting image includes a first area containing a first fluorescent material, a second area containing a second fluorescent material, and a protective layer formed on the first fluorescent material of the first area and the second fluorescent material of the second area;

at least a part of the second area is adjacent to the first area;

the first fluorescent material and the second fluorescent material are configured to emit light of colors that are a same color when invisible light within a first wavelength range is independently irradiated and when invisible light within a second wavelength range is independently irradiated; and the first fluorescent material and the second fluorescent material are configured to emit light of colors that arc different colors from each other when the invisible light within the first wavelength range and the invisible light within the second wavelength range are simultaneously irradiated.

2. The light-emitting medium according to claim 1, wherein the protective layer is made of a substantially transparent material through which the invisible light within the first wavelength range and the invisible light within the second wavelength range may transmit.

3. The light-emitting medium according to claim 1, wherein the protective layer contains an acrylic resin.

4. The light-emitting medium according to claim 3, wherein the protective layer is made of polymethyl methacrylate.

5. A light-emitting medium including a light-emitting image on a substrate wherein:

the light-emitting image includes a first area containing a first fluorescent material, a second area containing a second fluorescent material, and a protective layer formed on the first fluorescent material of the first area and the second fluorescent material of the second area;

at least a part of the second area is adjacent to the first area;

the first fluorescent material and the second fluorescent material are configured to emit light of colors that are different colors from each other when invisible light within a first wavelength range is independently irradiated;

the first fluorescent material and the second fluorescent material are configured to emit light of colors that are different colors from each other when invisible light within a second wavelength range is independently irradiated, the colors being different from the colors of the light when the invisible light within the first wavelength range is independently irradiated; and the first fluorescent material and the second fluorescent material are configured to emit light of colors that are a same color when the invisible light within the first wavelength range and the invisible light within the second wavelength range arc simultaneously irradiated.

6. A light-emitting medium including a light-emitting image on a substrate wherein:

the light-emitting image includes a plurality of first pattern elements containing a first fluorescent material, a plurality of second pattern elements containing a second fluorescent material, and a protective layer formed on the substrate, the first pattern elements and the second pattern elements;

the plurality of first pattern elements and the plurality of second pattern elements form a plurality of micro-characters;

the plurality of micro-characters form micro-character rows, and the first pattern elements form a latent image in the micro-character rows;

the first fluorescent material and the second fluorescent material are configured to emit light of colors that are a same color when invisible light within a first wavelength range is independently irradiated and when invisible light within a second wavelength range is independently irradiated; and the first fluorescent material and the second fluorescent material are configured to emit light of colors that are different colors from each other when the invisible light within the first wavelength range and the invisible light within the second wavelength range are simultaneously irradiated, whereby the latent image in the micro-character rows appears.

7. The light-emitting medium according to claim 6, wherein the protective layer is made of a substantially transparent material through which the invisible light within the first wavelength range and the invisible light within the second wavelength range may transmit.

8. The light-emitting medium according to claim 6, wherein the protective layer contains an acrylic resin.

9. The light-emitting medium according to claim 8, wherein the protective layer is made of polymethyl methacrylate.

10. A light-emitting medium including a light-emitting image on a substrate wherein:

the light-emitting image includes a plurality of first pattern elements containing a first fluorescent material, a plurality of second pattern elements containing a second fluorescent material, and a protective layer formed on the substrate, the first pattern elements and the second pattern elements;

the plurality of first pattern elements and the plurality of second pattern elements form a plurality of micro-characters;

the plurality of micro-characters form micro-character rows, and the first pattern elements form a latent image in the micro-character rows;

the first fluorescent material and the second fluorescent material are configured to emit light of colors that are different colors from each other when invisible light within a first wavelength range is independently irradiated, whereby the latent image in the micro-character rows appears;

the first fluorescent material and the second fluorescent material are configured to emit light of colors that are different colors from each other when invisible light within a second wavelength range is independently irradiated, the colors being different from the colors of the light when the invisible light within the first wavelength range is independently irradiated, whereby the latent image in the micro-character rows appears; and the first fluorescent material and the second fluorescent material are configured to emit light of colors that are a same color when the invisible light within the first wavelength range and the invisible light within the second wavelength range are simultaneously irradiated.

11. The light-emitting medium according to claim 10, wherein the protective layer is made of a substantially transparent material through which the invisible light within the first wavelength range and the invisible light within the second wavelength range may transmit.

12. The light-emitting medium according to claim 10, wherein the protective layer contains an acrylic resin.

13. The light-emitting medium according to claim 12, wherein the protective layer is made of polymethyl methacrylate.

* * * * *